US007258599B2

(12) United States Patent
Shirasu

(10) Patent No.: US 7,258,599 B2
(45) Date of Patent: Aug. 21, 2007

(54) POLISHING MACHINE, WORKPIECE SUPPORTING TABLE PAD, POLISHING METHOD AND MANUFACTURING METHOD OF SEMICONDUCTOR DEVICE

(75) Inventor: Tetsuya Shirasu, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 115 days.

(21) Appl. No.: 11/320,073

(22) Filed: Dec. 29, 2005

(65) Prior Publication Data

US 2007/0060024 A1 Mar. 15, 2007

(30) Foreign Application Priority Data

Sep. 15, 2005 (JP) ..... 2005-268274
Sep. 29, 2005 (JP) ..... 2005-283802

(51) Int. Cl.
*B24B 1/00* (2006.01)

(52) U.S. Cl. ..... 451/41; 451/388; 451/398

(58) Field of Classification Search ..... 451/41, 451/285–289, 397, 398, 388, 339, 444
See application file for complete search history.

(56) References Cited

U.S. PATENT DOCUMENTS 6,086,457 A * 7/2000 Perlov et al. ..... 451/41
6,257,966 B1 * 7/2001 Ishikawa et al. ..... 451/67
6,402,598 B1 * 6/2002 Ahn et al. ..... 451/65
6,780,083 B2 8/2004 Ising et al.
6,833,109 B1 12/2004 Aoki et al.
6,860,801 B2 * 3/2005 Yang et al. ..... 451/388
6,910,956 B1 * 6/2005 Wu et al. ..... 451/67

FOREIGN PATENT DOCUMENTS

| | | |
|---|---|---|
| JP | 7-201786 | 8/1995 |
| JP | 9-174420 | 7/1997 |
| JP | 2000-277470 | 10/2000 |
| JP | 2003-71709 | 3/2003 |
| JP | 3439970 | 6/2003 |
| JP | 2005-523579 | 8/2005 |

* cited by examiner

*Primary Examiner*—Dung Van Nguyen
(74) *Attorney, Agent, or Firm*—Westerman, Hattori, Daniels & Adrian, LLP.

(57) ABSTRACT

A pedestal pad (workpiece supporting table pad) is arranged on the top of a pedestal (workpiece supporting table) for temporarily placing and holding a pre-polished or post-polished wafer (workpiece). This pedestal pad is formed of resin, and at least a surface of the pedestal pad which comes into contact with the wafer is non-absorbable to a fluid. The tissue of the pedestal pad is dense and smooth, and does not have any cavity, such as fine holes, which holds the fluid.

20 Claims, 30 Drawing Sheets

THE SOURCE OF SUPPLY OF NITROGEN GAS
THE SOURCE OF SUPPLY OF PURE WATER
THE VACUUM PUMP

POLISHING MACHINE, WORKPIECE SUPPORTING TABLE PAD, POLISHING METHOD AND MANUFACTURING METHOD OF SEMICONDUCTOR DEVICE

CROSS-REFERENCE TO RELATED APLICATIONS

This application is based upon and claims priority of Japanese Patent Application No. 2005-268274, filed on Sep. 15, 2005 and Japanese Patent Application No. 2005-283802, filed on Sep. 29, 2005, the contents being incorporated herein by reference.

BACKGROUND OF THE INVENTION

1. Field of the Invention

The present invention relates to a polishing machine of polishing a workpiece with a slurry, a workpiece supporting table pad, and a polishing method. Specifically, the present invention relates to a polishing machine including a machine for temporarily placing and holding a pre-polished or post-polished workpiece on a workpiece supporting table; a workpiece supporting table pad; and a polishing method.

The present invention also relates to a manufacturing method of a semiconductor device which is manufactured using CMP (chemical mechanical polishing) and a polishing machine suitable for CMP used for manufacturing a semiconductor device and, more particularly to a manufacturing method of a semiconductor device and a polishing machine whereby an abrasive adhered to a polished surface is cleaned quickly.

2. Description of the Prior Art (First Prior Art)

In recent years, as semiconductor devices have been increasingly miniaturized, surfaces of wafers (semiconductor substrates) on which insulating films and conductor films are formed are required to be smoothed with precision. In order to meet the needs, chemical mechanical polishing (CMP) machines are widely used nowadays. CMP machines are used in various processes for manufacturing semiconductor devices, such as polishing silicon wafers which are going to be turned into substrates, forming interconnects by use of the damascene method, and smoothing insulating films. In addition, CMP machines are used for manufacturing hard discs (magnetic recorders), manufacturing multichip modules (MCMs: hybrid integrated circuits), polishing lenses, and doing the like.

FIG. 1 is a schematic diagram showing an outline of a CMP machine used for manufacturing semiconductor devices. As shown in FIG. 1, the CMP machine includes a platen (table) 10, a polishing head (polishing carrier) 14, a slurry supplying nozzle 15 and a conditioning disc 12.

An abrasive pad (abrasive cloth) 11 is mounted on the platen 10. This platen 10 is fixed to a rotary shaft 10*a*, and rotates in response to rotation of the rotary shaft 10*a*. The polishing head 14 is disposed above the platen 10. A member for adsorbing and holding a wafer 13 is provided to the underside of this polishing head 14, and this member is termed as a membrane. The polishing head 14 is fixed to a rotary shaft 14*a*, and rotates in response to rotation of the rotary shaft 14*a*.

A conditioning disc 12 is also disposed above the platen 10. This conditioning disc 12 is fixed to a rotary shaft 12*a*, and rotates in response to rotation of the rotary shaft 12*a*. This conditioning disc 12 is used for keeping the surface of the abrasive pad 11 in a condition optimal for polishing the wafer during and after the polish. The conditioning disc 12 is also termed as a conditioner, and as a dresser.

The slurry supplying nozzle 15 is connected to a slurry supplying machine (not illustrated) through a tube 15*a*. A slurry is dropped from the slurry supplying nozzle 15 to the abrasive pad 11. A slurry dropped to the top of the abrasive pad 11 is supplied to the interstice between the abrasive pad 11 and the wafer 13 by means of rotation of the platen 10. Furthermore, a surface of the wafer 13 is mechanically and chemically polished with an abrasive (abrasive grains) and a chemical fluid contained in the slurry and the abrasive pad 11.

FIG. 2 is a perspective view of the CMP machine. FIG. 3 is a diagram showing a cross-section view of a load cup (also termed as a load/unload station or an HCLU) of the CMP machine and a partial cross-section view of the polishing head of the CMP machine. Detailed descriptions will be provided for the CMP machine by use of these figures.

As shown In FIG. 2, generally used CMP machines are provided with a plurality of platens 10 (three platens 10 in the figure) and a load cup 20 on a base 2. A slurry supplying arm 31 provided with slurry nozzles at the end of the slurry supplying arm 31 and a conditioning disc driving arm 32 to which a conditioning disc 12 is attached are arranged around each of the platens 10. In addition, the polishing head 14 is attached to a head unit 30 supported by a rotary shaft 30*a*. In the case of the CMP machine shown in FIG. 2, three platens 10 and one load cup 20 are arranged around the rotary shaft 30*a*. The head unit 30 is provided with four polishing heads 14 corresponding to the three platens 10 and the lord cup 20. Wafers are transferred to the tops of the respective platens 10 by means of causing the head unit 30 to rotate while the wafers are adsorbed and held by the polishing head 14. Incidentally, the rotary shafts 14*a* of the polishing heads 14 are designed to reciprocate in the direction of a radius in which the head unit 30 rotates as shown by arrows in FIG. 2.

As shown in FIG. 3, the inside the load cup 20 is provided with a pedestal (workpiece supporting table) 21 for temporarily holding the wafers 13 (workpieces) which are going to be polished, or which have been polished. The inside of this pedestal 21 is a hollow, and the top of the pedestal 21 is provided with a plurality of nozzles (holes) 21*a* connecting with the hollow. The unfilled space (hollow) inside the pedestal 21 is connected with an internal unfilled space inside a hollowed shaft 22 supporting the pedestal 21. This internal unfilled space of the shaft 22 is connected to a source of supply of nitrogen gas, a source of supply of pure water and a vacuum pump through a plurality of selector valves (not illustrated).

Furthermore, the inside of the load cup 20 is provided with a positioning member (not illustrated) for aligning the wafers 13 respectively to the polishing heads 14. Incidentally, in the case of the CMP machine shown in FIGS. 2 and 3, the periphery of the pedestal 21 is provided with nozzles 23 for ejecting pure water to the polishing heads 14. These nozzles 23 are connected to the source of supply of pure water through piping 24.

The bottom of each of the polishing heads 14 is provided with an adsorbing member including a membrane 16 made of a thin film of rubber. This adsorbing member is connected to an air pressure regulating system. When the inner unfilled space of the adsorbing member is placed under a negative pressure, the membrane 16 is depressed upwards, and thus adsorbs the wafer 13. Such a configuration of CMP machines has been known heretofore (see Japanese Patent Laid-open Official Gazette Nos. 2003-71709 and Hei. 9-174420, and Japanese Patent Official Gazette No. 3439970, for example).

It should be noted that, as shown in a side view of FIG. 4A, a pedestal pad 25 is arranged on the pedestal 21 for the purpose of preventing the surface of the wafer 13 from being scratched. This pedestal pad 25 is made of a soft material. Specifically, the pedestal pad 25 is a two-layered configuration, where the upper layer is a vertical foam made of polyurethane, and the lower layer is a layer obtained by impregnating a non-woven fabric made of polyurethane fibers with polyurethane resin. Moreover, as shown in a plan view of FIG. 4B, the pedestal pad 25 is provided with holes 25*a* at positions matching with the nozzles 21*a* provided to the pedestal 21.

Incidentally, it is known that copper to be used for interconnects is prevented from being oxidized and corroded by means of keeping wafers, which have been polished by CMP, in an aqueous solution of benzotriazole (BTZ) (see Japanese Patent Laid-open Official Gazette No. 2000-277470, for example).

Generally, aluminum is used as a material for interconnects of semiconductor devices. However, in the case of highly-integrated and highly-performing semiconductor devices, copper is more used as the material for interconnects than aluminum, since copper has a smaller resistivity than aluminum and copper less causes electro-migration than aluminum. Chemical reaction makes greater contribution in a case where copper is polished by CMP than in a case when insulating films are polished by CMP. Incidentally, copper is more likely to be oxidized and corroded. In addition, the surface of copper which has been polished by CMP is extremely active, and oxidation and corrosion easily occurs in the surface. For this reason precautions are necessary for not only selection of a slurry and a cleaning fluid, but also treatment of wafers which have been polished.

However, in the case of conventional CMP machines, copper is likely to be oxidized and corroded from a time of completion of the polish until a time of the unloading (wafers are transferred out of the polishing machines). For this reason, further ingenuity has been required.

(Second Prior Art)

CMP is widely used, in a manufacturing process of a semiconductor device, for example, for planarization of an interlayer dielectric film, formation of embedded wiring and the like. As a polishing machine for performing CMP, a dry-in/dry-out polishing machine which combines a polishing unit having a platen and a cleaning unit for performing cleaning after polishing has been used recently. Hereinafter, a description is given for a conventional polishing machine which combines a polishing unit and a cleaning unit.

FIG. 5 is a plan view of a conventional polishing machine, showing a substantial configuration of a polishing machine which combines a polishing unit and a cleaning unit. A polishing machine 300, the whole of which is accommodated in a clean room 301, includes a carry-in/carry-out unit 310 for carrying a wafer in the clean room 301 or carrying out of the clean room 301, a polishing unit 320 for polishing the wafer by CMP, and a cleaning unit 340 for cleaning the wafer. The units are separated from each other so that an airflow between the units will be less in order to maintain a clean atmosphere in each unit.

On the carry-in/carry-out unit 310, a cassette 314 for accommodating the wafer before and after polishing is mounted. A robot arm 311 is also provided for taking the wafer out of the cassette 314 or accommodating the wafer in the cassette 314.

The polishing unit 320 has two platens 321 and 322, and a turntable 325 is provided therebetween. An abrasive pad is attached to the top surface of the platens 321 and 322 so as to supply slurry. Also, two polishing heads 323, 324 are provided for each of the platens 321 and 322, and the wafer held on the bottom of the heads 323 and 324, is polished by being pressed against the abrasive pad. The heads 323 and 324 are movable vertically relative to the sheet of FIG. 5.

A turntable 125, which has four placing tables 326 on the top surface thereof, is turned to carry a wafer placed on a placing table 326.

Furthermore, the wafer placed on the placing table 326 can be cleaned with a cleaning fluid.

In addition, between the turntable 325 and the platen 321, and between the turntable 325 and the platen 322, cleaning stages 327 and 328 for cleaning the wafer are provided respectively. The cleaning stages 327 and 328 rotatingly travel from the position shown in FIG. 5 to the position of the placing table 326 and can carry the wafer between the positions.

The cleaning unit 340 includes two cleaners 342 and 343, stages 341 and 345 for carrying-in and for carrying-out, a drier 344, and a robot arm 346 for carrying a wafer rotatingly.

The wafer is taken out of the cassette 314 by the robot arm 311, and then placed on a thicknessmeter 313 as a point of delivery. The wafer placed on the thicknessmeter 313 is carried in the polishing unit 320 by the robot arm 312, and then placed on the placing table 326 provided in the polishing unit 320.

The wafer placed on the placing table 326 is adsorbed on the bottom of either of the heads 323 or 324, carried to the top surface of the platens 321 and 322 by the travel of the heads 323 and 324. The wafer is then pressed against the abrasive pad on the top surface of the platens 321 and 322 at that position, and then polished.

The polished wafer is carried to the cleaning stage 328 by the travel of the heads 323 and 324, cleaned there, and then placed on the placing table 326.

Next, after carrying the wafer placed on the placing table 326 to the thicknessmeter 313 followed by measuring its thickness, the robot arm 312 places the wafer on the placing table 326 again. Then, using the platen different from the one used for the previous polishing, the wafer is finish-polished and brought back to the placing table 326 through the cleaning stage.

The finish-polished wafer is placed on the stage 341 in the cleaning unit 340 by the robot arm 312. After being carried to the drier 344 through the cleaner 342 for main cleaning and the cleaner 343 for finish cleaning and then dried, the finish-polished wafer is placed on the stage 345 by the robot arm 346.

The wafer placed on the stage 345 is accommodated by the robot arm 311 again in the cassette 314 for accommodating the wafer. Thus, the polishing machine, in which all the polishing steps are automatically taken, can achieve a dry-in/dry-out process without manual operations during the process. Consequently, all the polishing steps including polishing and cleaning can be taken at a highly clean atmosphere, thereby obtaining an excellent polished surface with fewer defects (for example, see PC (WO) No. 2005-523579).

The inventors of the present application, however, think that the above described conventional polishing machine has the following problems. Specifically, the conventional polishing machine carries the polished wafer to the placing table or cleaning stage and then cleans the polished surface of the wafer. Consequently, there is time for a few seconds from the end of polishing until the clean of the polished surface, when the polished surface, in a state that slurry remains adhered to the polished surface, is exposed to an atmosphere. As a result, the wiring appearing on the polished surface, particularly copper wiring, corrodes and consequently, the quality of the semiconductor device to be manufactured is deteriorated.

The experiments conducted by the inventors of the present invention clarifies that slurry is left even on the polished surface immediately after the so-called water polishing; consequently the surface of the copper wiring corrodes if exposed to an atmosphere; and the corrosion proceeds within 1–2 sec. It is from when the head holding the wafer on its bottom rises thereby separating the wafer from the abrasive pad until when the wafer starts being cleaned on the cleaning stage that the polished surface is exposed to an atmosphere immediately after polishing. Therefore, in order to suppress the corrosion of the copper wiring appearing on the polished surface, the wafer has to be cleaned before carrying to the cleaning stage after polishing.

It has been known that an improved polishing machine which prevents the corrosion on the surface of a compound semiconductor appearing as a polished surface by a polishing fluid, by cleaning the wafer quickly immediately after polishing (for example, see JP H07-201786A).

FIGS. 6A and 6B are figures for illustrating an operation of the conventional improved polishing machine, indicating a method of quickly cleaning the wafer immediately after polishing by cross-sectional views of the polishing machine. It should be noted that FIGS. 6A and 6B show a state immediately after polishing and a state when the head rises.

Referring to FIG. 6A, in this improved polishing machine, a wafer 364 held on the bottom of a polishing head 365 is polished by pressing against an abrasive pad 382 attached to the top surface of a platen 381. Immediately before the end of polishing, the wafer 364 travels to a prescribed position close to a periphery of the platen 381. Outside the platen 381, close to the prescribed position, a nozzle 376 for spraying a cleaning fluid 376*b* is provided.

Referring to FIG. 6B, the head 365 rises simultaneously with the end of polishing, the wafer 364 is held at a cleaning position above the platen 381 with a polished surface 364*a* downward. Next, the cleaning fluid 376*b* is sprayed from the nozzle 376 on the polished surface 364*a* of the wafer 364 so as to clean the polished surface 364*a*. The polishing machine, which starts cleaning the wafer 364 at a time of raising the head 365, can suppress the corrosion of the polished surface 364*a* drastically compared with a polishing machine which cleans the wafer 364 by carrying to a cleaning stage. It should be noted that a cleaning fluid 363*a* is supplied on the top surface of the abrasive pad 382 from the shower 363 immediately after raising the head 365 so as to clean the abrasive pad 382.

Also in the improved polishing machine, however, during the period from when the wafer 364 is separated from the abrasive pad 382 by the rise of the head 365 until when held at the cleaning position, since the polished surface 364*a* of the wafer 364 is exposed to an atmosphere, the corrosion proceeds on the polished surface 364*a*. Since the corrosion of the copper wiring proceeds rapidly in particular, unignorable corrosion occurs even during a time of raising the head 365 and consequently, the semiconductor device becomes less reliable.

It should be noted that the corrosion occurring during a time of carrying the wafer 364 from the abrasive pad 382 to a cleaning stage (for example, cleaning stages 327 and 328 shown in FIG. 5) in the abovementioned normal polishing process. The corrosion is corrosion on the surface layer of the copper wiring, and is corrosion enough to discolor the surface of the copper wiring. At the same time, serious corrosion enough to corrode the entire copper wiring (all the layers) occurs in case of trouble.

FIG. 7 is a sequence of the conventional polishing machine in case of trouble, and shows a sequence of the main operations of the polishing machine prearranged for time of trouble. Referring to FIG. 7, the conventional polishing machine is designed, when an occurrence of a trouble is detected, to stop its operation and wait for an operator's decision after taking the following (1)–(3) steps: (1) adsorbing the wafer to the head, raising from the abrasive pad, and suspending by holding; (2) stopping the rotation of the platen and head; and (3) stopping supplying slurry on the abrasive pad, supplying the cleaning fluid on the abrasive pad, and then rinsing the abrasive pad.

In such a sequence in case of trouble, during the period from when a trouble is detected and the head rises until when the operator makes a decision and reoperation, the polished surface of the wafer is exposed to an atmosphere with slurry remaining adhered thereto. Since it takes normally several minutes before the operator conducts the operation, the copper wiring to which slurry is adhered corrodes through all the layers thereof during this time. As a result, the trouble occurrence in the polishing machine causes a fatal defect in the semiconductor device, thereby decreasing the manufacturing yield of the semiconductor device drastically.

As described above, in the conventional CMP polishing machine (polishing machine for performing chemical mechanical polishing), when carrying the wafer from the platen to another apparatus, the wafer is firstly carried to an intermediate stage (for example, cleaning stage or placing table) and then cleaned on the intermediate stage. However, during a time of carrying the wafer from the platen to the intermediate stage, the wiring metal surface appearing on the polished surface of the wafer corrodes thereby deteriorating the reliability of the semiconductor device.

In the conventional improved CMP polishing machine which sprays a cleaning fluid from the nozzle on the polished surface of the wafer held above the platen after polishing so as to clean the polished surface, since the wafer can be cleaned before carrying to the intermediate stage, the corrosion can be greatly improved. However, by the time when the wafer is held at a cleaning position on the platen, specifically, during the period from when the wafer separates from the abrasive pad until rising up to the cleaning position, the metal wiring surface appearing on the polished surface corrodes and consequently, it is difficult to fully suppress the corrosion of the metal wiring appearing on the polished surface.

Furthermore, in the conventional CMP polishing machine, the machine stops in case of trouble, leaving the wafer held on the platen, and the wafer is left without cleaning. Consequently, there is a problem in that the wiring layer appearing on the polished surface corrodes through all the layers (from the surface to the bottom of the wiring layer). Since all the layers thus corroded cannot be recovered by the repolishing which removes only the surface layer, the manufacturing yield of the semiconductor device decreases.

SUMMARY OF THE INVENTION

With regard to the present invention, a comprehensive problem is to prevent corrosion of surfaces of metal interconnects which have been polished. Specifically, an object of the present invention is to provide: a polishing machine which makes it possible to prevent oxidation, corrosion and other troubles from occurring to a post-polished workpiece; a workpiece supporting table pad of the polishing machine; and a polishing method.

It is an object of the present invention to provide a manufacturing method of a semiconductor device which eliminates time when the polished surface of a wafer is exposed to an atmosphere during a period from the end of polishing until cleaning using CMP so as to suppress the corrosion of a wiring metal appearing on the polished surface, and a polishing machine which achieves such CMP.

In order to solve the abovementioned problems, a polishing machine according to a first configuration of the present invention includes a polishing stage, a workpiece supporting table, a workpiece supporting table pad and a polishing head. The workpiece supporting table pad is arranged on the workpiece supporting table, and at least a surface of the pad which comes into contact with a workpiece is non-absorbable to a fluid. The polishing head transfers the workpiece, which is placed on the workpiece supporting table pad, to the polishing stage, and returns the workpiece, which has been polished by the polishing stage, to the top of the workpiece supporting table pad.

In order to solve the abovementioned problems, a workpeice supporting table pad of a polishing machine according to a second configuration of the present invention is pad, which is made of resin, which is arranged on the workpiece supporting table. A pre-polished or post-polished workpiece is temporarily placed on the workpiece supporting table pad. At least a surface of the pad which comes into contact with the workpiece is non-absorbable to a fluid.

In order to solve the abovementioned problems, a polishing method according to a third configuration of the present invention includes the following steps: a step of placing a workpiece on a workpiece supporting table; a step of transferring the workpiece from the top of the workpiece supporting table to a polishing stage by use of a polishing head; a step of polishing the workpiece by use of the polishing stage; and a step of returning the workpiece which has been polished to the top of the workpiece supporting table. A workpiece supporting table pad is arranged on the workpiece supporting table, and at least a surface of the pad which comes into contact with the workpiece is non-absorbable to a fluid.

In the case of the present invention, the workpiece supporting table pad made of resin is arranged on the workpiece supporting table. A surface of this workpiece supporting table pad which comes into contact with the workpiece is non-absorbable to the fluid. In other words, the surface of the pad which comes into contact with the workpiece is smooth, and does not have any interstice which holds the fluid. Consequently, water (or another fluid: the same hereinafter) dropped on the workpiece supporting table pad is easily removed from the workpiece supporting table pad along with pure water which is used when polishing heads are cleaned in the load cup. This prevents occurrence of troubles, including oxidation, corrosion and dissolution of the surface of the workpiece due to water or a chemical dropped to the top of the workpiece supporting table pad.

It is advantageous that grooves extending to an outer edge of the workpiece supporting table pad be formed in the surface of the workpiece supporting table pad which comes in contact with the workpiece in order to efficiently discharge water dropped to the top of the workpiece supporting table. The water dropped to the top of the workpiece supporting table pad passes through the grooves, and is discharged from the outer edge of the workpiece supporting table pad when the wafer is placed on the workpiece supporting table pad.

In the case where the workpiece supporting table is provided with nozzles connected to the source of supply of the fluid and the vacuum device, holes need to be made in the workpiece supporting table pad so that the nozzles are not occluded. In this case, if the grooves connect with the holes, air flows into the nozzles through the grooves when the workpiece is being adsorbed to the top of the workpiece supporting table pad. This is likely to make it impossible for the workpiece to be fully adsorbed to the top of the workpiece supporting table pad. For this reason, it is advantageous that the grooves be formed in a way that the grooves do not connect with the holes.

In addition, the workpiece supporting table pad may be configured of a plurality of individual pad-constituting members. In this case, it is advantageous that the workpiece supporting table pad includes ring-shaped pad-constituting members surrounding the nozzles of the workpiece supporting table.

In order to solve the abovementioned problems, a manufacturing method of a semiconductor device according to a fourth configuration of the present invention includes the following steps: a step of spraying a cleaning fluid (for example, pure water) below the periphery of the head and on the abrasive pad surface appearing adjacent to the outside of the periphery of the head at a first spray angle after polishing step; next, a step of spraying the cleaning fluid into the interstice between the polished surface and the abrasive pad surface formed early in the course of raising the head at a second spray angle equal to or smaller than the first spray angle; and then, a step of spraying the cleaning fluid by following the polished surface with the rise of the head.

In the fourth configuration, after polishing and before raising the head, in a state that the wafer is put on the abrasive pad in close relation, a cleaning fluid is sprayed below the periphery of the head and on the abrasive pad surface appearing adjacent thereto. Next, raising the head, in a state that an interstice is formed between the wafer and the abrasive pad, the cleaning fluid is sprayed into the interstice without changing the spray angle or making it smaller.

In this configuration, before raising the head, since the surface of the abrasive pad adjacent to the head and the periphery of the head are soaked in the cleaning fluid, even if a slight interstice is formed between the wafer and the abrasive pad by raising the head, the interstice is filled with the cleaning fluid. Therefore, the polished surface is not exposed to an atmosphere. Furthermore, since the cleaning fluid is sprayed into the interstice becoming larger as raising the head, the sprayed cleaning fluid keeps on filling the interstice. Therefore, even if the interstice becomes larger to some extent, the polished surface is never exposed to an atmosphere.

It should be noted that, in order to spray the cleaning fluid into the interstice reliably, it is preferable to emit spray at a smaller spray angle almost parallel to the abrasive pad surface. At the same time, a small spray angle is not preferable because the cleaning fluid is interrupted by the abrasive pad thereby decreasing the flow volume of the cleaning fluid. Therefore, the spray angle has to be set properly based on the experiments.

When the head is further raised thereby making the interstice between the wafer and the abrasive pad further larger, the cleaning fluid is sprayed directly on the rising polished surface. The step of spraying the cleaning fluid directly on the polished surface is taken after when the interstice becomes larger thereby the head rises high enough to realize a spray angle at which the cleaning fluid can be sprayed directly on the polished surface. After that, the cleaning fluid is sprayed by following the polished surface rising together with the rise of the head. Consequently, the polished surface is always covered with the cleaning fluid even during a time of raising the head, the polished surface is never exposed to an atmosphere.

Thus, in the fourth configuration, since the polished surface is always cleaned by spraying the cleaning fluid during the period from immediately after polishing until the end of the head rise, the polished surface is covered with the cleaning fluid and consequently, the polished surface is never exposed to an atmosphere. Also, since the polished surface is cleaned sufficiently, even if the wafer is carried to another stage, for example, the cleaning stage subsequently, the wiring metal corrosion appearing on the polished surface is suppressed sufficiently. Consequently, according to the fourth configuration, the wiring metal corrosion appearing on the polished surface after polishing by CMP is suppressed sufficiently.

A fifth configuration of the present invention relates to a polishing machine suitable for the CMP used for the manufacturing method of the semiconductor device in the above fourth configuration.

The polishing machine of the fifth configuration includes a nozzle having a nozzle opening for spraying a cleaning fluid and a nozzle controlling means for controlling the position of the nozzle opening and the spray direction of the cleaning fluid.

The nozzle controlling means controls the nozzle opening position and the cleaning fluid spray direction so as to execute the following sequences (1)–(3) continuously in order.

(1) After finishing the polishing step, a cleaning fluid is sprayed below the periphery of the head and on the abrasive pad surface appearing adjacent to the outside of the periphery of the head at a first spray angle.

(2) The cleaning fluid is sprayed into the interstice between the polished surface and the abrasive pad surface formed together with the rise of the head at second spray angle equal to or smaller than the first spray angle.

(3) The cleaning fluid is sprayed on the polished surface by following the polished surface rising together with the rise of the head.

The polishing machine according to the fifth configuration performs the CMP process of the manufacturing method of the semiconductor device of the first configuration by executing the above sequences. In the CMP using the polishing machine of this configuration, therefore, the same operation/effect can be achieved as in the fourth configuration of the present invention.

In the fifth configuration, a nozzle controlling means controls the nozzle opening position and the cleaning fluid spray direction. Specifically, the nozzle opening position is controlled simultaneously with the spray angle. Since this enables the position and direction for spraying the cleaning fluid to be controlled precisely, the polished surface can be interrupted from an atmosphere reliably. As a matter of course, as long as the polished surface can be covered with the cleaning fluid, either one (for example, spray direction only) may be controlled.

A polishing machine of a sixth configuration according to the present invention, which includes an discharge port for a cleaning fluid, opening on the top surface of the platen; a pad opening located on the discharge port, passing through the abrasive pad; and a head moving means for moving the head onto the discharge port and then rising. During a period from after moving the head at least until raising the head, the polishing machine keeps on spraying the cleaning fluid from the discharge port on the polished surface of the wafer.

In the polishing machine, after polishing, the head holding the wafer slidingly travels onto the discharge port within the platen top surface so that the cleaning fluid sprayed from the discharge port is applied on the polished surface of the wafer. The cleaning fluid is preferably sprayed in order to reach the polished surface ceaselessly even during raising the wafer subsequently. It should be noted that the distance that the wafer rises for the occasion has to be the distance that the cleaning fluid sprayed from the discharge port reaches the polished surface.

In the polishing machine of the sixth configuration, the polished surface of the wafer, remaining in contact with the abrasive pad, is cleaned by the cleaning fluid sprayed from below (discharge port of the platen). Even if the wafer rises thereby separating the polished surface from the abrasive pad, the cleaning fluid reaches the polished surface and keeps on cleaning the polished surface. Consequently, the polished surface, during a period from being put on the abrasive pad until the head is rose, is cleaned consistently by the cleaning fluid and the polished surface is never exposed to an atmosphere during this time. Therefore, corrosion of the wiring metal on the polished surface is suppressed.

In the sixth configuration, the discharge port is preferably opened so as to spray the cleaning fluid in a traveling direction of the top surface of the rotating platen. This enables a large volume of the cleaning fluid to be supplied without disturbing a flow of the cleaning fluid on the platen top surface, and cleaning with little contamination becomes possible.

In a polishing machine of a seventh configuration according to the present invention, a water tank for overflowing a cleaning fluid below the platen is provided; the platen and the water tank are vertically moved relative to each other; and the abrasive pad is soaked in the cleaning fluid inside the water tank.

In this configuration, in a state that the wafer is in contact on the abrasive pad after polishing, the platen top surface can be soaked in the cleaning fluid. Consequently, without exposing the polished surface to an atmosphere after polishing, the wafer can be cleaned in the cleaning fluid. Therefore, the corrosion of the metal wiring appearing on the polished surface is suppressed. Also, since the surface of the abrasive pad attached on the platen and the polished surface are cleaned with a large volume of the cleaning fluid in the water tank, the slurry left on the polished surface is cleaned quickly. Therefore, the corrosion of the wiring metal caused by the slurry left on the polished surface is reduced.

An eighth configuration of the present invention relates to processing of the polishing machine in case of trouble. The polishing machine of the eighth configuration includes an emergency stopping means for raising the wafer by being adsorbed to the head and for stopping the rotation of the platen when an abnormality of the machine is detected, and an emergency cleaning means for moving the raised head to a cleaning apparatus so as to clean the polished surface of the wafer.

In this configuration, when an abnormality is detected, the head raised above the platen (holding wafer), without being held above the platen, travels to the cleaning apparatus so as to clean at least the polished surface of the wafer. After cleaning, the operator's operation is then awaited. In this configuration, since the polishing machine stops in a state that the polished surface is cleaned, the metal wiring on the polished surface corrodes to an extent that only the shallow surface corrodes during a period from stop until restart, in the same manner as at normal operation, and all the layers of the metal wiring never corrode. Therefore, by repolishing the shallow surface, normal metal wiring without corrosion can be formed in the same manner as in the normal polishing step. Consequently, the decrease in manufacturing yield caused by the stop of the polishing machine when abnormality occurs can be avoided.

DESCRIPTION OF THE PREFERRED EMBODIMENTS

The present inventor and his group have been in search of causes which oxidize and corrode copper from a time of completion of CMP polish until a time of unload. Hereinafter, detailed description will be provided for the causes.

FIGS. 8A to 8E are schematic diagrams showing displacement of wafers and movement of a head unit of a CMP machine.

Figure 8A:
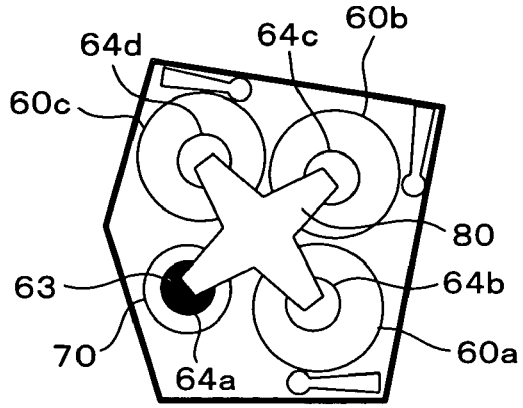
FIGS. 8A to 8E are schematic views showing displacement of wafers and movement of a head unit in the CMP machine.
Figure 8B:
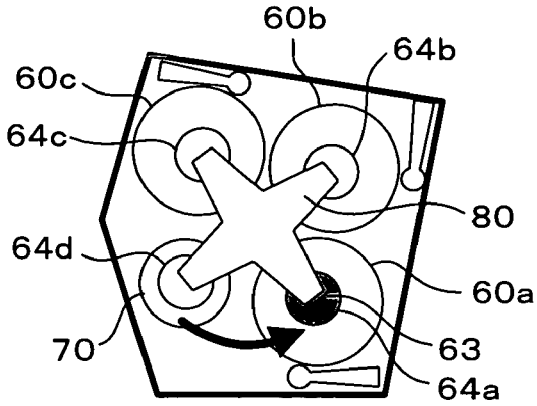

First of all, a wafer 63 is transferred to a load cup 70, and is placed on a pedestal, by a transfer robot, as shown in FIG. 8A. Then, the wafer 63 on the pedestal is held by the polishing head 64*a*. Thereafter, the head unit 80 turns at approximately 90 degrees in the left direction, and thus the wafer 63 is transferred to a first platen (first polishing stage) 60*a*, as shown in FIG. 8B. Subsequently, the wafer 63 is polished by CMP with the first platen 60*a*.

When the first platen 60*a* completes polishing the wafer 63 by CMP, the wafer 63 is held by the polishing head 64*a*.

Figure 8C:
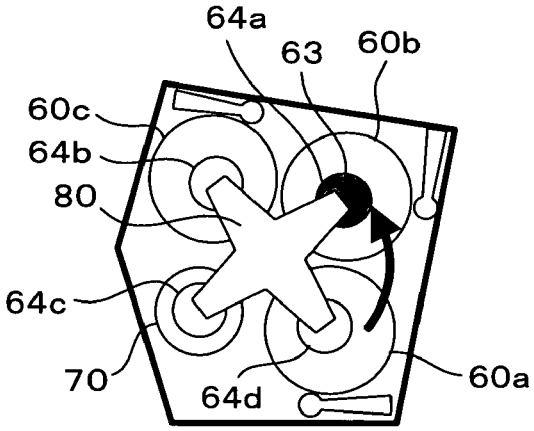

Thereafter, the unit head 80 turns at approximately 90 degrees in the left direction again, and thus the wafer 63 is transferred to a second platen (second polishing stage) 60*b*, as shown in FIG. 8C. Subsequently, the wafer 63 is polished by CMP with the second platen 60*b*.

Figure 8D:
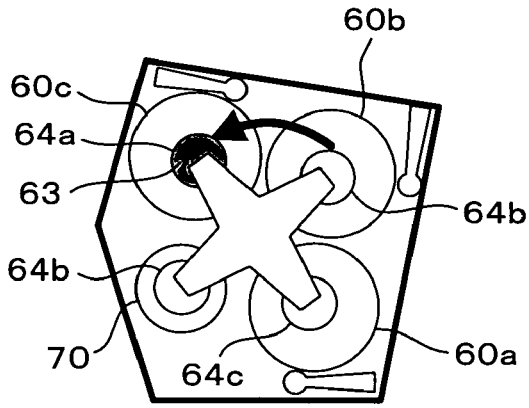

When the second platen 60*b* completes polishing the wafer 63 by CMP, the wafer 63 is held by the polishing head 64*a*. Thereafter, the head unit 80 turns at approximately 90 degrees once again, and thus the wafer 63 is transferred to a third platen (third polishing stage) 60*c*, as shown in FIG. 8D. Subsequently, the wafer 63 is polished by CMP with the third platen 60*c*.

Figure 8E:
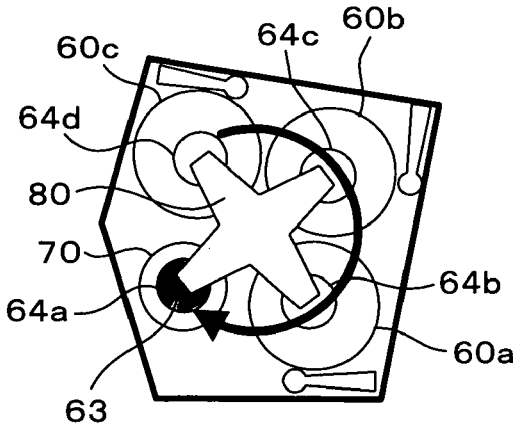

When the third platen 60*c* completes polishing the wafer 63 by CMP, the wafer 63 is held by the polishing head 64*a*, and thus is returned to the lord cup 70, as shown in FIG. 8E. Then, the wafer 63 is placed on the pedestal. At this time, the head unit 80 turns at approximately 270 degrees in the right direction. Thereafter, the wafer 63 on the pedestal is transferred out of the CMP machine by the transfer robot.

In this manner, the wafer 63 is transferred in the sequence from the load cup 70, the first platen 60*a*, the second platen 60*b*, the third platen 60*c* to the load cup 70.

It should be noted that, for polish of a wafer by CMP, there are a method of polishing the wafer on a particular platen only (in other words, the wafers are not transferred from one platen to another) and a method (divided-polishing method) of polishing the wafer with a plurality of platens sequentially as described above. In the case of the process of manufacturing semiconductor devices, the latter method is adopted more than the former method in order to increase throughput.

Incidentally, while the wafer 63 which has been polished by CMP with the third platen 60*c* is being returned to the load cup 70, the head unit 80 turns reversely. For this reason, the other wafers 63 which are held respectively by the other polishing head 64*b* to 64*d*, and which are in the middle of being polished, pass over the load cup 70. In the platens 60*a* to 60*c*, the surfaces of the wafers 63 are cleaned by means of discharging pure water from the slurry supplying nozzles when the polish is completed. Nevertheless, water containing slurry ingredients remains in the surfaces of the wafers 63 and the polishing heads 64*a* and 64*d*, although the water is small in amount. This water is likely to drop on the pedestal pad of the load cup 70 while the wafers are being transferred.

Since the load cup 70 is cleaned with pure water, even if the water containing the slurry ingredients drops to the top of the pedestal pad, the dropped water can be removed to some extent. However, as described above, conventional pedestal pads made of vertical foam of polyurethane, the pads have honeycombed fine holes in their surfaces. For this reason, parts of the water containing the slurry ingredients remain in these holes. Consequently, when the wafer 63 which has been polished is placed on the pedestal pad, the polished surface of the wafer 63 and the water containing slurry ingredients come into contact with each other. This oxidizes and corrodes a metallic film (copper film in particular) on the surface of the wafer, although depending on kinds and concentration of the slurry ingredients contained in the water. If, in particular, copper ions are contained in the water dropped on the pedestal pad, this makes it easy for the copper film to be dissolved, and this accelerates oxidation and corrosion of the copper film.

In order to decrease the amount of slurry dropping to the top of the pedestal pad, it can be conceived that the head unit 80 is caused to make a constant unidirectional turn (in other words, the head unit 80 is cause to make no reverse turn). However, in this case, something has to be done lest the wiring and tubing passing inside the rotary shaft supporting the head unit 80 should be twisted, and this would make the system configuration complicated. In addition, if the head unit 80 would be caused to make a constant unidirectional turn, the water containing the slurry ingredients could not be completely prevented from dropping from the wafer 63 or the polishing head 64*a* to 64*d* to the pedestal pad.

It should be noted that, in a case where copper is polished by CMP, corrosion and oxidation stemming from water remaining on the surface of the pedestal pad occur conspicuously. In addition, in a case where a film made of a metal, such as tungsten (W), titanium (Ti), aluminum (Al), tantalum (Ta), silver (Ag), gold (Au), platinum (Pt) and ruthenium (Ru), is polished, troubles including oxidation, corrosion and partial dissolution of the metal, occur depending on the slurry ingredients. Furthermore, in a case where a semiconductor film, such as a polycrystalline silicon film and an amorphous silicon film, is polished, and in a case where an insulting film, such as a SiO film, a $SiO_2$ film, a SiOC film, a SiC film, a SiON film, a SiN film and a BPSG film, is polished, the film is likely to be partially dissolved depending on the slurry.

Through the aforementioned examination, the present inventors and his group has come to a conclusion that, even if water containing slurry ingredients (or another fluid) drops to the top of the pedestal pad, it is important to do something in order that the water (or another fluid) can not remain in the pedestal pad. Hereinafter, embodiments of the present invention will be described.

First Embodiment

Figure 9:
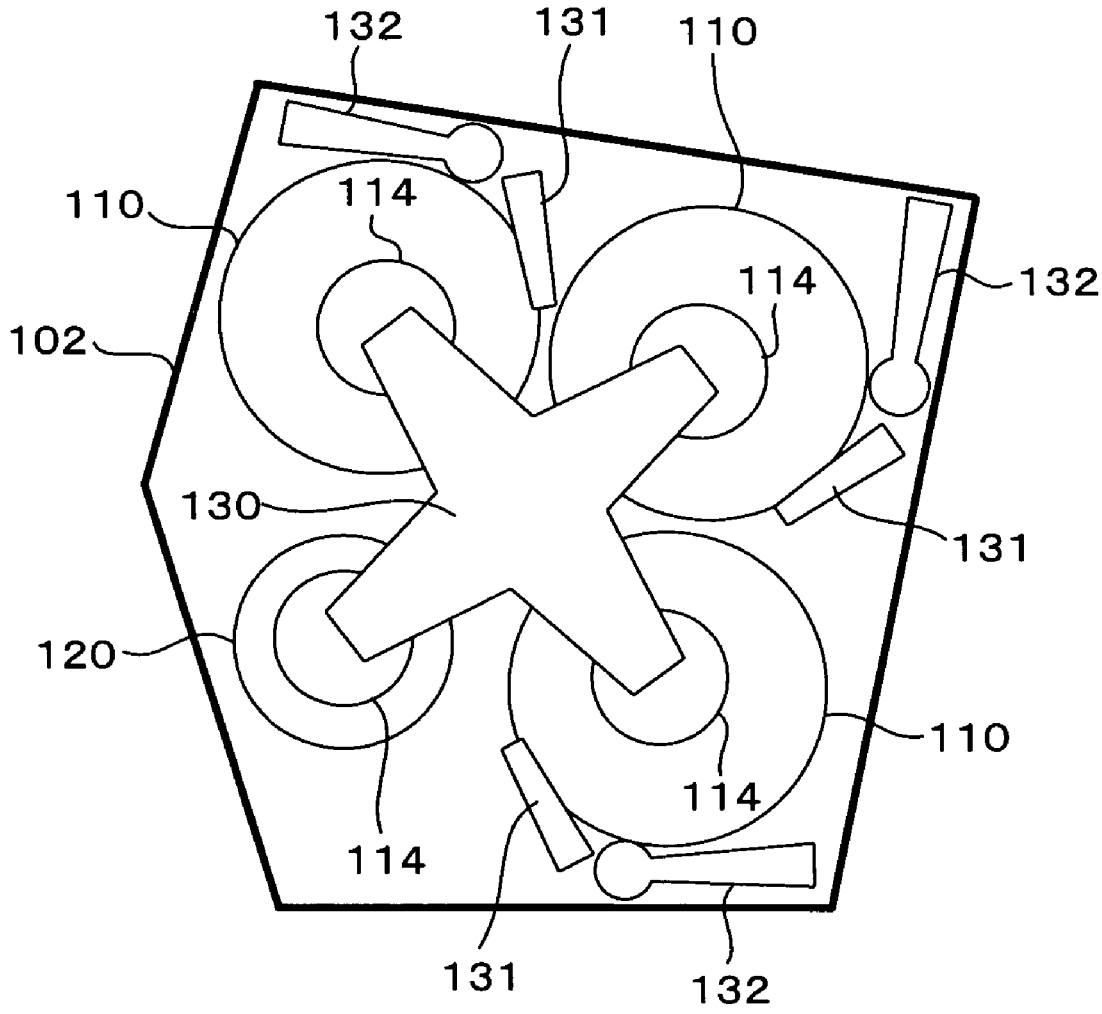
FIG. 9 is a top view showing a polishing machine (a CMP machine) according to a first embodiment of the present invention.

FIG. 9 is a top view showing a polishing machine (a CMP machine) according to a first embodiment of the present invention.

The polishing machine according to this embodiment is provided with three platens (polishing stages) 110 and one load cup 120 on the base 102. A slurry supplying arm 131 and a conditioning disc driving arm 132 are provided around each of the platens 110. Slurry supplying nozzles are provided to the end of the slurry supplying arm 131. A conditioning disc is attached to the conditioning disc driving arm 132. An abrasive pad (abrasive cloth) is mounted onto the top of each of the platens 110.

In addition, four polishing heads 114 are attached to a head unit 130 supported by a rotary shaft while corresponding to the platens 110 and a load cup 120. By means of causing the head unit 130 to rotate while wafers are adsorbed to, and held by, the respective polishing heads 114, the wafers are transferred to the respective platens 110. Incidentally, the polishing heads 114 is designed not only to rotate in response to the respective rotary shafts, but also to reciprocate in the direction of radius in which the unit head 130 rotates.

Figure 10:
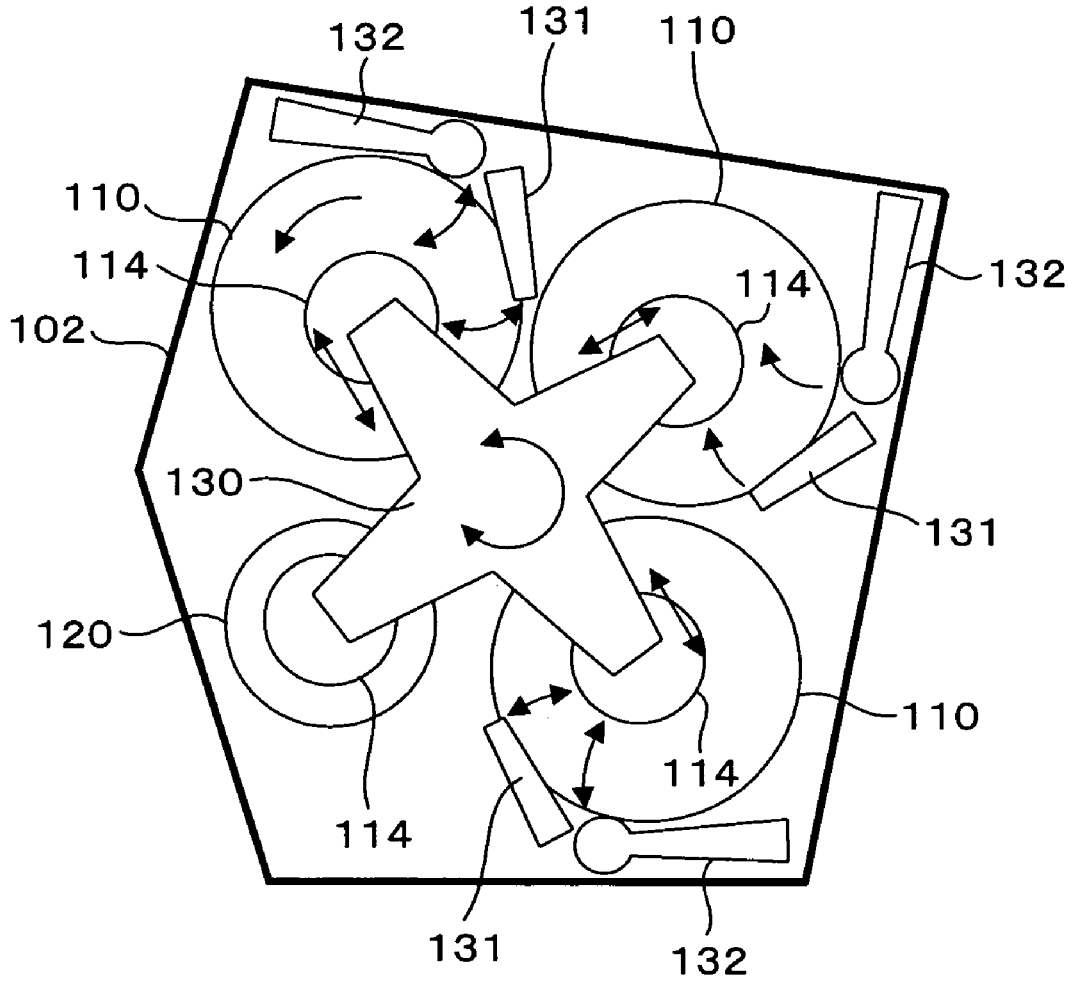
FIG. 10 is a top view showing operations of a polishing heads, the head unit, slurry supplying arms and conditioning disc driving arms

FIG. 10 shows operations of the polishing heads 114, the unit head 130, the slurry supplying arms 131 and the conditioning disc driving arms 132. In FIG. 10, the polishing heads 114, the head unit 130, the slurry supplying arms 131 and the conditioning disc driving arms 132 are operated respectively in the directions shown by arrows.

Figure 11:
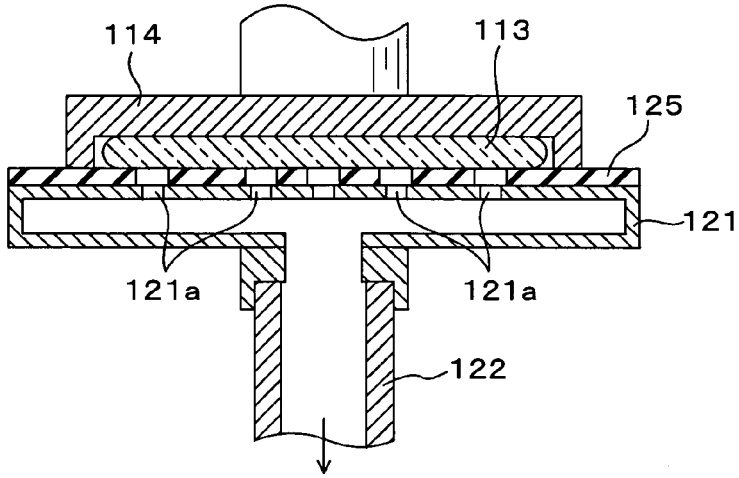
FIG. 11 is a cross-sectional view showing a pedestal and a pedestal pad.

As shown in FIG. 11, the inside of the load cup 120 is provided with a pedestal (workpiece supporting table) 121 for temporarily holding a pre-polished or post-polished wafer (workpiece) 113. The inside of this pedestal 121 is a hollow, and the top of the pedestal 121 is provided with a plurality of nozzles (holes) 121*a* connecting with the hollow.

The hollow inside the pedestal 121 is connected with an internal unfilled space of a hollowed shaft 122 supporting the pedestal 121. The internal unfilled space of the shaft 122 is connected with a source of supply of nitrogen gas, a source of supply of pure water (cleaning water) and a vacuum pump through a plurality of selector valves (not illustrated). In addition, the inside of the load cup 120 is provided with a positioning member (not illustrated) for aligning the wafers 113 respectively to the polishing heads 114.

Figure 12:
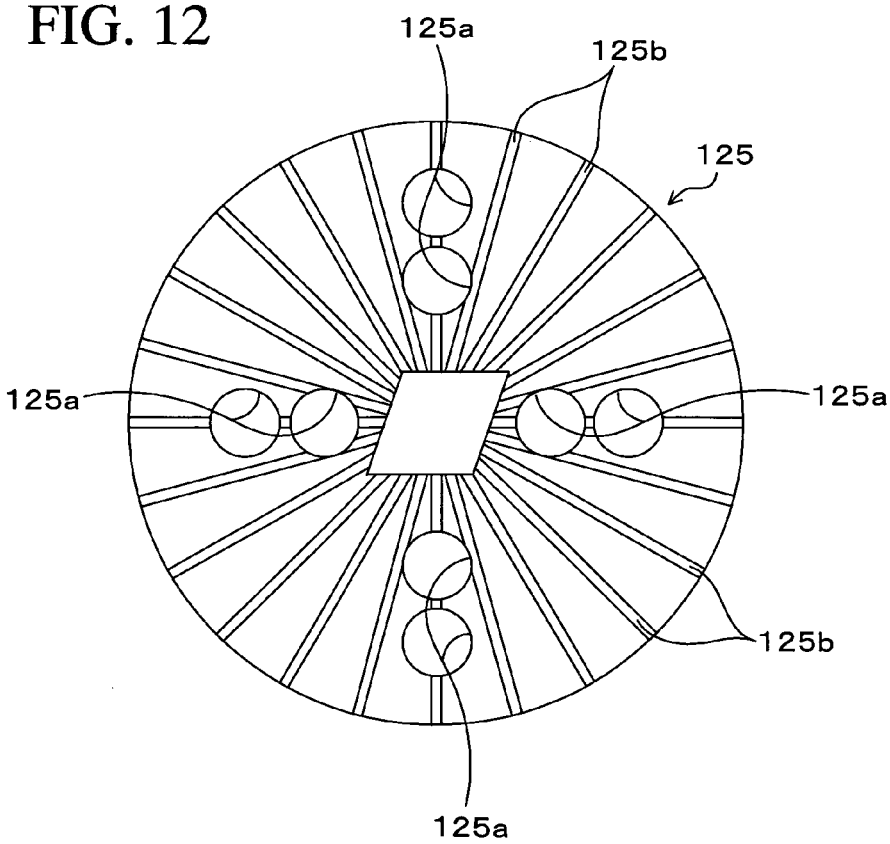
FIG. 12 is a plan view showing a pedestal pad of the polishing machine according to the first embodiment.

A pedestal pad 125 shown in a plan view of FIG. 12 is joined to the top of the pedestal 121. This pedestal pad 125 is formed of a sheet of polyurethane which is a sort of plastic. The surface of the pedestal pad 125 (which surface comes into contact with the wafer) is smooth, and does not have any fine cavity (hole and the like) holding water (a fluid). The pedestal pad 125 is provided with holes (opening portions) 125*a* at positions corresponding to the nozzles 121*a* of the pedestal 121. In this example, a hole 125*a* at the center is shaped like a rhombus, and the other holes 125*a* are shaped like a circle.

Furthermore, the pedestal pad 125 is provided with grooves 125*b* spreading in a radiating manner. In this embodiment, the pedestal pad 125 is 183.4 mm in diameter, and is 1 to 2 mm in thickness. The grooves 125*b* are 5 mm in width, and are 0.1 to 0.7 mm in depth. Incidentally, the pedestal pad 125 may be formed of a sheet of another sort of plastic or rubber. The pedestal pads 125 can be formed, for example, of resin whose chief ingredient is polyurethane, resin whose chief ingredient is polyethylene, resin of whose chief ingredient is polyvinyl chloride, resin whose chief ingredient is acrylic, neoprene or the like. Nevertheless, at least a surface of the pedestal pad 125 which comes into contact with the wafer (workpiece) needs to be non-absorbable to a fluid. In other words, it is necessary that at least the surface of the pedestal pad 125 which comes into contact with the wafer (workpiece) should be smooth, and that the surface should not have a cavity like a fine hole holding water (the fluid).

Figure 13A:
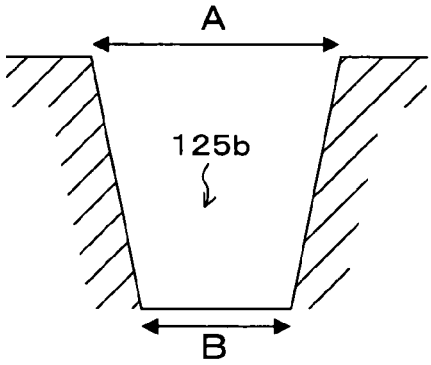
FIGS. 13A and 13B are diagrams respectively showing examples of cross-sectional shapes of grooves of the pedestal pad.
Figure 13B:
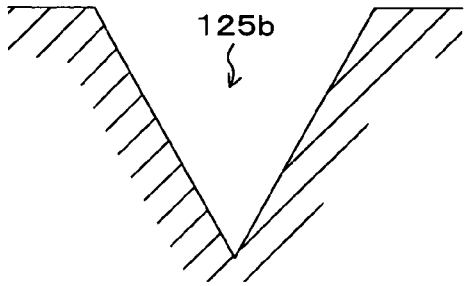
Figure 14:
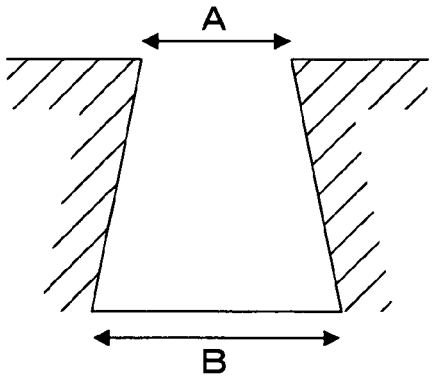
FIG. 14 is a diagram showing an example where, with regard to the cross-sectional shape of a groove, the width in an upper part is narrower and the width in a lower part is wider.

It is advantageous that the grooves 125*b* be equal to 1 mm or more in width for the purpose of smoothly discharging the water. Moreover, the grooves 125*b* may be shaped so that the upper width A of the cross section is wider and the lower width B of the cross section is narrower, as shown in FIGS. 13 A and 13B. In a case where the grooves are shaped, for example, so that the upper width A of the cross section is narrower and the lower width B of the cross section is wider as shown in FIG. 14, it is considered that water is hard to be discharged since the water adheres to wall surfaces of the grooves due to the surface tension. By contrast, in the case where the cross sections of the grooves 125*b* have the shapes shown in FIGS. 13A and 13B, the water is prevented from adhering to the wall surfaces of the grooves 125*b*.

Figure 15:
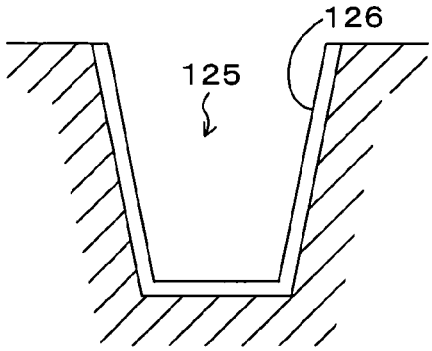
FIG. 15 is a cross-sectional view showing an example where water-repellent or hydrophobic films are adhered to the wall surfaces and the bottom surface of each of the grooves of the pedestal pad.

As well, it is advantageous that the wall surfaces and the bottom surfaces of the grooves 125*b* be formed to be as smooth as possible in order to smoothly discharge water. For example, water-repellent or hydrophobic films 126 may be attached to the wall surfaces and the bottom surface of each of the grooves 125*b* as shown in FIG. 15. Such films can be formed by means of coating the wall surfaces and the bottom surface of each of the grooves 125*b* with a water-repellent or hydrophobic chemical while covering parts other than the grooves 125*b* with masks.

On the other hand, the bottom of each of the polishing heads 114 is provided with an adsorbing member (not illustrated) including a membrane made of a thin film of rubber. This adsorbing member is connected to an air pressure regulating system. When the internal unfilled space is placed under a negative pressure, the membrane is depressed upward, and thus the adsorbing member adsorbs the wafer 113.

Figure 16:
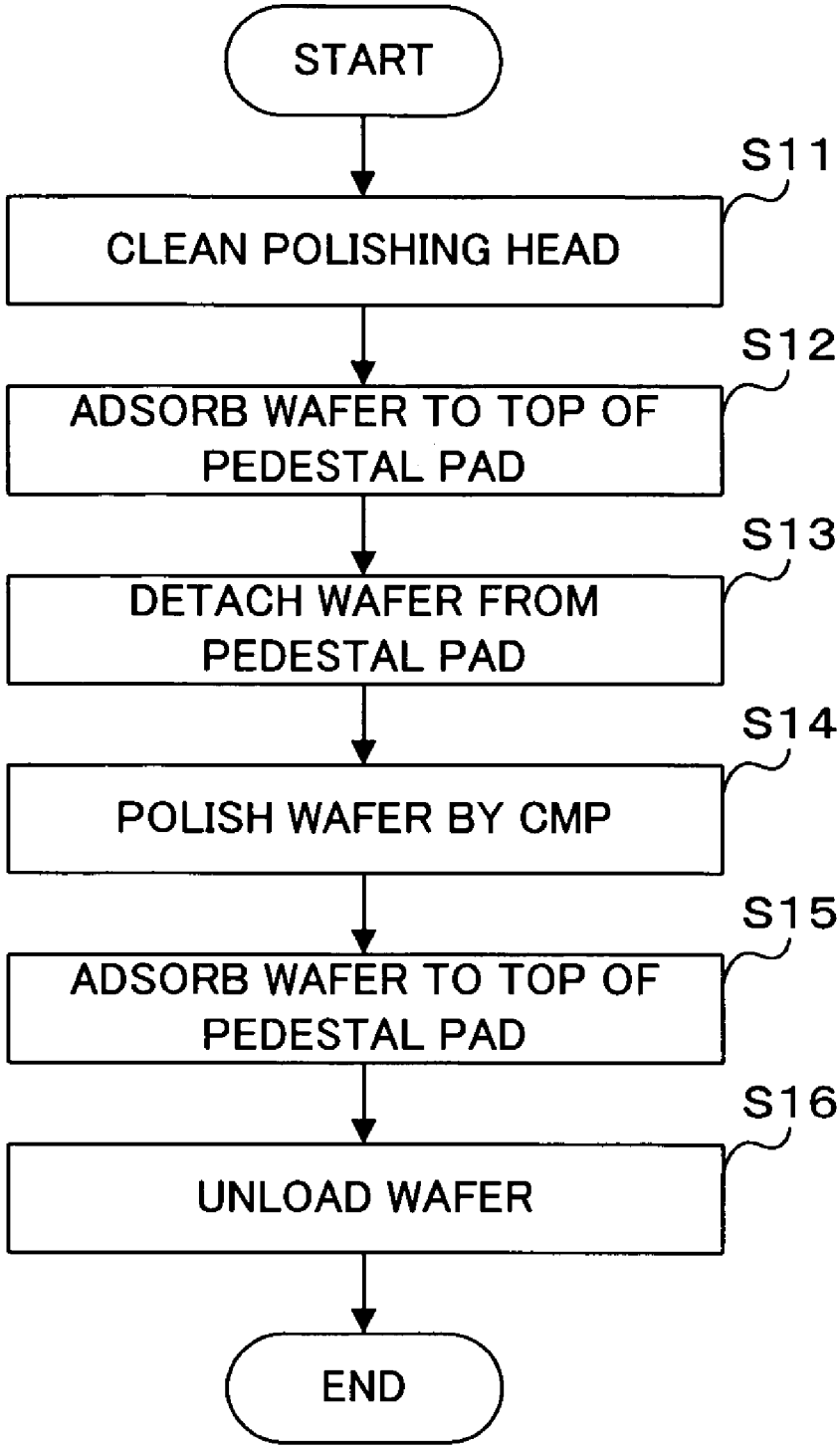
FIG. 16 is a flowchart showing operations of the polishing machine according to the first embodiment.

Descriptions will be provided below for operations of the polishing machine according to this embodiment with reference to a flowchart shown in FIG. 16. Incidentally, the abrasive pads are mounted respectively on the platens 110.

First of all, one of the polishing head 14 is cleaned in step S11 (see FIG. 11). Specifically, the selector valve is operated in order that the unfilled space (hollow) of the pedestals 121 is connected with the source of supply of pure water. Thereafter, pure water is supplied from the source of supply of pure water to the pedestal 121. The pure water is ejected from the nozzles 121*a*, and thus the polishing head 114 over the load cup 120 is cleaned.

Subsequently, after the cleaning of the polishing head 114 is completed, the process proceeds to step S12, where a transfer robot (not illustrated) transfers a wafer 113 from a wafer pod to the top of the pedestal 121 (pedestal pad 125) in the load cup 120. Thereafter, the selector valve is switched, and thus the internal unfilled space of the pedestal 121 is connected with the vacuum pump so that the internal unfilled space of the pedestal 121 is placed under the negative pressure. Thereby, the wafer 113 is adsorbed to the top of the pedestal 121 (pedestal pad 125).

Then, the process proceeds to step S13, where the selector valve is switched after the transfer robot escapes. Thus, the internal unfilled space of the pedestal 121 is connected with the source of supply of pure water or the source of supply of nitrogen gas. Thereby, pure water or nitrogen gas is ejected from the nozzles 121*a*, and the wafer 113 is detached from the pedestal 121 (pedestal pad 125). Subsequently, the wafer 113 is aligned to the polishing head 114 by means of the positioning member.

Thereafter, the process proceeds to step S14, where the wafer is polished by CMP. Specifically, the membrane is operated by means of the air pressure regulating system, and thus the wafer 113 is adsorbed by the polishing head 114. Then, the head unit 130 rotates, and thus displaces the wafer 113 to one of the platens 110 (see FIG. 9). Subsequently, the polishing head 114 rotates, and concurrently the slurry is supplied from the end (slurry supplying nozzles) of the slurry supplying arm 131 to the top of the abrasive pad. In addition, by means of the air pressure regulating system, the membrane inside the polishing head 114 is driven, and thus is swollen downwards. Thereby, the wafer 113 is pressed against the abrasive pad. The platen 110 rotates while the wafer 113 is being pressed against the abrasive pad in this manner. The slurry is supplied to the interstice between the wafer 113 and the abrasive pad, and thus the surface of the wafer 113 is mechanically and chemically polished.

After the polish of the wafer 113 is completed, by means of the air pressure regulating system, the membrane is driven, and thus the wafer 113 is adsorbed by the polishing head 114. Subsequently, by means of rotation of the head unit 130, the wafer 113 is returned to the top of the load cup 120.

Subsequently, the process proceeds to step S15, where the membrane is driven by means of the air pressure regulating system, and thus the wafer 113 is detached from the polishing head 114. At this time, the internal unfilled space of the pedestal 121 is connected to the vacuum pump by means of switching the selector valve, and thus the wafer 113 is adsorbed to the top of the pedestal 121 (pedestal pad 125). Then, the process proceeds to step S16, the wafer 113 is transferred out of (unloaded from) the top of the pedestal 121 (pedestal pad 125), for example, to a cleaning system arranged along with the polishing machine.

In the case of this embodiment, the pedestal pad 125 is formed of a sheet of polyurethane which is a sort of plastic. The surface of the pedestal pad 125 (which comes into contact with the wafer) is smooth, and does not have any cavity, such as fine holes, which holds the water. In addition, the pedestal pad 125 is provided with grooves 125*b* spreading in a radiating manner. For this reason, even if the water containing the slurry ingredients drops to the top of the pedestal 125, the slurry ingredients on the top of the pedestal 125 are easily removed from the top of the pedestal pad 125 along with pure water when the polishing head 114 is cleaned with the pure water (in step S11). Consequently, no slurry ingredients remain on the top of the pedestal pad 125 (parts of the pedestal pad 125 which comes into contact with the wafer). As a result, oxidation, corrosion and the like are inhibited from occurring on the surface of the wafer. This makes it possible manufacture semiconductor devices which are of higher reliability and higher quality than ever before.

Somebody may think that, since the pedestal pad 125 according to this embodiment has no layer made up of polyurethane vertical foam unlike conventional pedestal pads, damage is more likely to occur on the surface of the wafer. However, through the experiments conducted by the present inventor and his group, it has been proven that, even if a polyurethane sheet which has a smooth part coming into contact with the wafer is use, damage is hard to occur on the wafer.

Next, descriptions will be provided for a result of examining of the number of defects which occurred on the surface of a wafer (semiconductor wafer) when a copper film on the surface of the wafer was polished by CMP with the polishing machine according to this embodiment.

Many wafers each with a diameter of 8 inches were made ready as polishing samples, and a copper film was formed on the surface of each of the wafers. Subsequently, as an experimental example, the wafers were sequentially polished by use of the polishing machine according to this embodiment. The number of defects on the surface of a wafer which was polished in the first place was measured, and the number of defects on the surface of a wafer which was polished in the 25th place was measured. Incidentally, a hydrogen peroxide solution was used, instead of the slurry, while the polish was being performed. The polish was a touch polish (a light polish under a low pressure). The hydrogen peroxide solution was used as an ingredient of the slurry for polishing copper. In addition, a defect inspection machine (AIT-XP) of KLA-Tencor Corporation was used for the measurement of the numbers of defects.

Figure 17A:
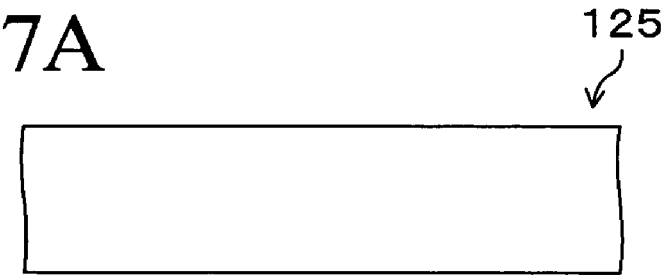
FIG. 17A is a cross-sectional view of a pedestal pad used in an experimental example.

FIG. 17A is a schematic cross-sectional view of a pedestal pad 125 used in the experimental example. As shown in FIG. 17A, the pedestal pad 125 used in the experimental example was made of a sheet of polyurethane resin, and the tissue was dense. The surface of the pedestal pad 125 (the surface which came into contact with the wafers) was smooth, and did not have any cavity, such as fine holes, which held water.

On the other hand, as a comparative example, wafers (wafers on whose surfaces the respective copper films were formed) were sequentially polished by use of a conventional polishing machine in the same condition as the wafers were polished in the experimental example. The conventional machine used a pedestal pad with a two-layered configuration having a layer of polyurethane vertical foam and a layer obtained by impregnating a non-woven cloth of polyurethane fibers with polyurethane resin. The number of defects on the surface of a wafer which was polished in the first place was measured, and the number of defects on the surface of a wafer which was polished in the 25th place was measured.

Figure 17B:
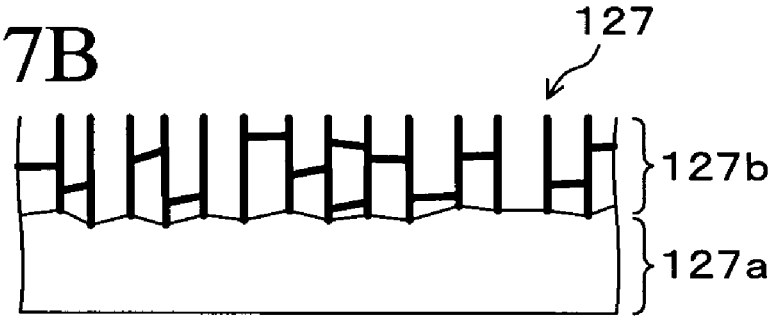
FIG. 17B is a cross-sectional view of a pedestal pad used in the comparative example.

FIG. 17B is a schematic cross-sectional view of the conventional pedestal pad 127 used on the comparative example. As shown in FIG. 17B, the conventional pedestal pad 127 had the two-layered configuration, in which the lower layer was a layer 127*a* obtained by impregnating a non-woven cloth of polyurethane fibers with polyurethane resin, and the upper layer was a layer 127*b* of polyurethane vertical foam. The conventional pedestal pad 127 has honeycombed fine holes in the surface. When the wafers are sequentially polished, water dropped on the top of the pedestal was held in these holes.

Figure 18A:
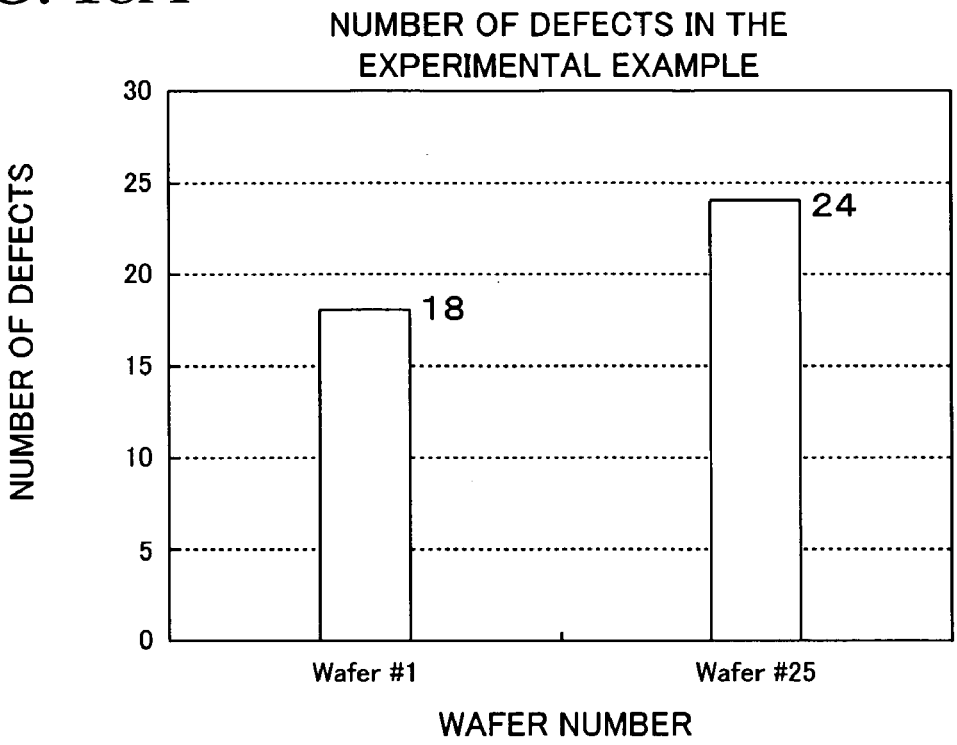
FIG. 18A is a diagram showing a result of measuring the number of defects in the experimental example.
Figure 18B:
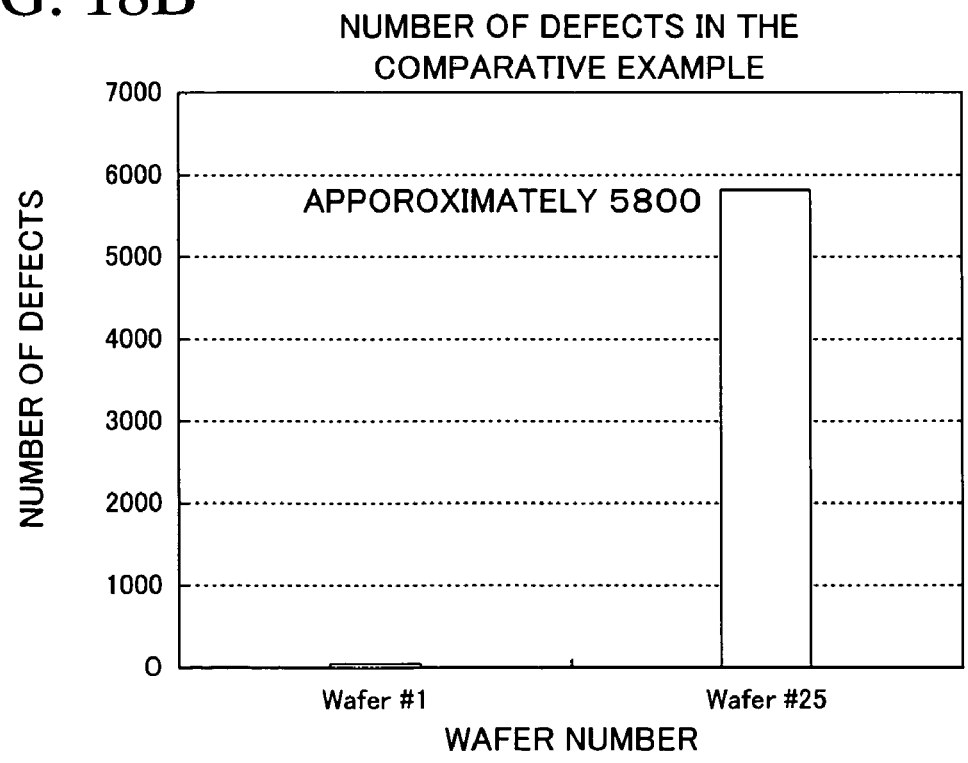
FIG. 18B is a diagram showing a result of measuring the number of defects in the comparative example.

FIG. 18A is a diagram showing a result of measuring the number of defects of the wafer which was polished by use of the polishing machine in the experimental example. FIG. 18B is a diagram showing a result of measuring the number of defects of the wafer which was polished by use of the polishing machine in the comparative example. As learned from FIG. 18B, with regard to the polishing machine in the comparative example, the number of the defects of the wafer which was polished in the first place was small, whereas approximately 5,800 defects were detected from the wafer which was polished in the 25th place. As learned from FIG. 18A, with regard to the polishing machine in the experimental example, the number of defects of the wafer which was polished in the first place was 18, whereas the number of defects of the wafer which was polished in the 25th place was 24. It was proved that, even if the wafers were polished sequentially, an extremely small number of defects occurred.

Hereinafter, descriptions will be provided for a method (dual damascene method) of forming copper interconnects by use of the polishing machine according to this embodiment with reference to FIGS. 19A to 19F. At this point, the descriptions will be provided for the method giving a case where a second layer of interconnects (copper interconnects) are formed on the top of a semiconductor substrate on which a first layer of interconnects (copper interconnects) has been formed. The interconnects of the first layer are formed by use of the same process as those of the third layer are formed.

Figure 19A:
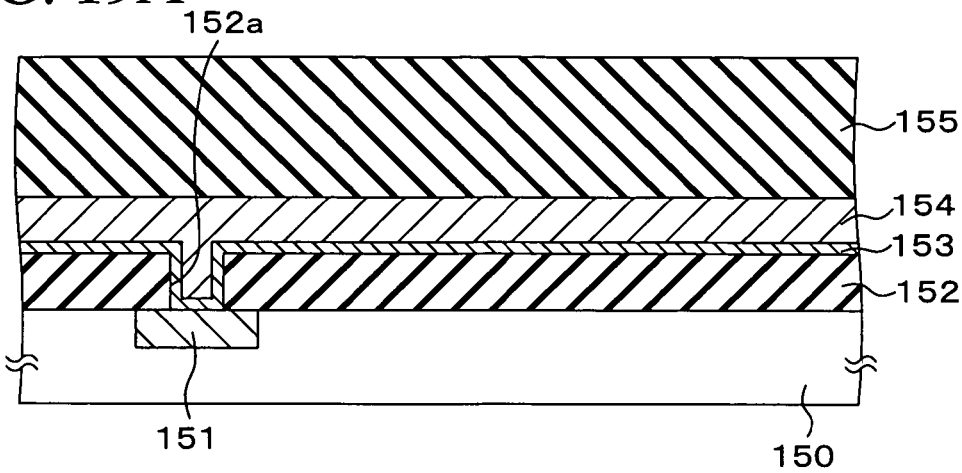
FIGS. 19A to 19F are cross-sectional views showing a method (dual damascene method) of forming copper interconnects by use of the polishing machine according to the embodiment.

As shown in FIG. 19A, an impurity diffusion layer 151, a first interlayer insulating film 152, a first barrier layer 153 and the first layer of interconnects 154 (copper interconnects) are formed on a semiconductor substrate (silicon wafer) 150. On top of the semiconductor substrate, a second interlayer insulating film 155 is formed of silicon oxide, for example, by use of the CVD method. At this point, the impurity diffusion layer 151 is a region which is used, for example, as a source/drain of a transistor. In addition, the first layer of interconnects 154 is electrically connected with the impurity diffusion layer 151 through the contact hole 152*a*. The barrier layer 153 is provided for the purpose of preventing copper from diffusing into the interlayer insulating film 152.

Figure 19B:
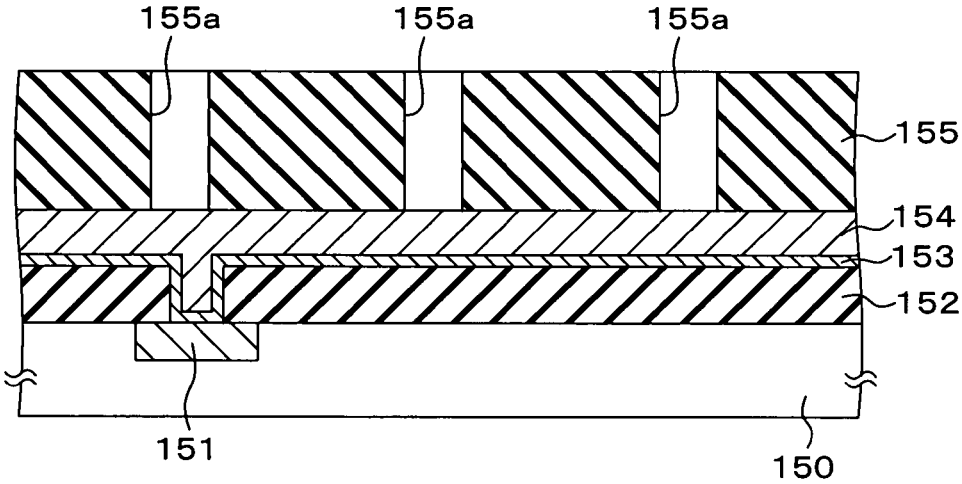
Figure 19C:
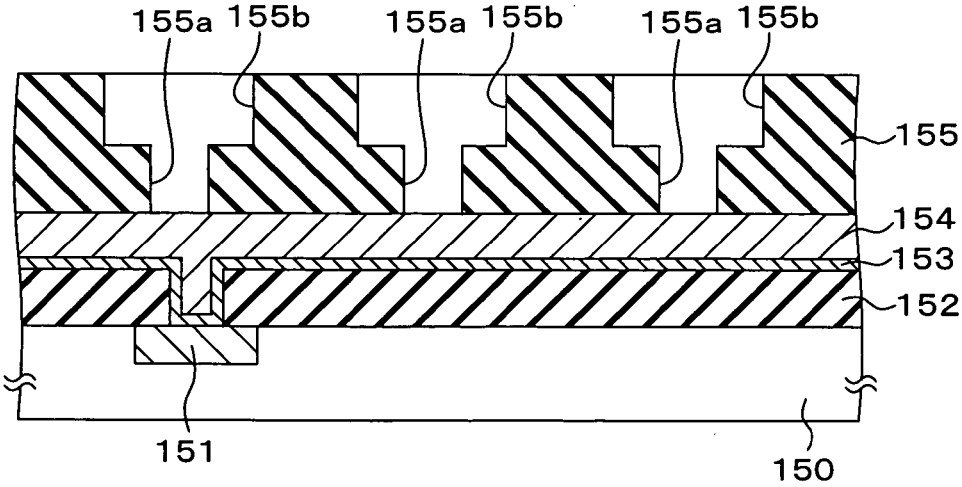

Then, contact holes 155*a* reaching the first layer of interconnects 154 from the top surface of the second interlayer insulating film are formed respectively at desired positions by use of the photolithography method, as shown in FIG. 19B. Subsequently, grooves 155*b* are formed in a desired interconnect pattern by use of the photolithography method, as shown in FIG. 19C. The depth of each of these grooves 155*b* is, for example, approximately one half of the thickness of the interlayer insulating film 155.

Figure 19D:
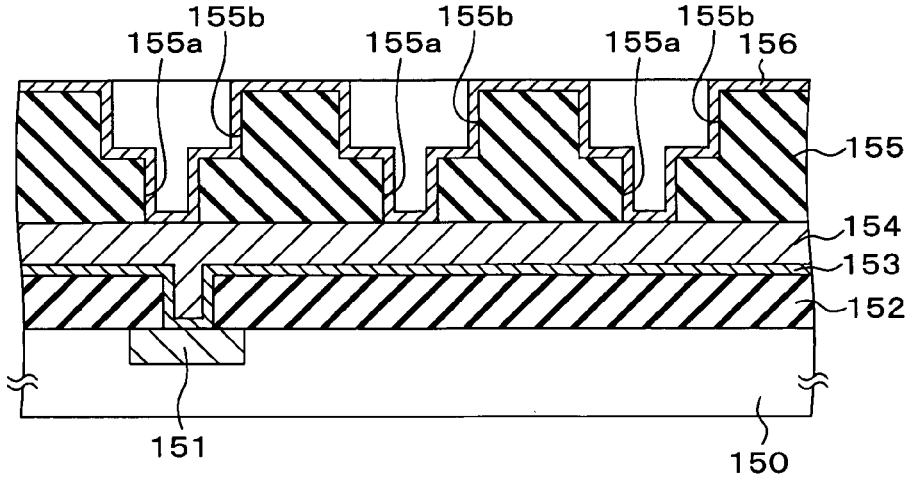

Thereafter, as shown in FIG. 19D, a barrier layer 156 is formed on the entire surface of the top on the semiconductor substrate 150 by use of the sputtering method. Not only the top of the second interlayer insulating film but also the wall surfaces and bottom surfaces of the grooves 155*b* as well as the wall surfaces and bottom surfaces of the contact holes 155*a* are covered with this barrier layer 156.

Figure 19E:
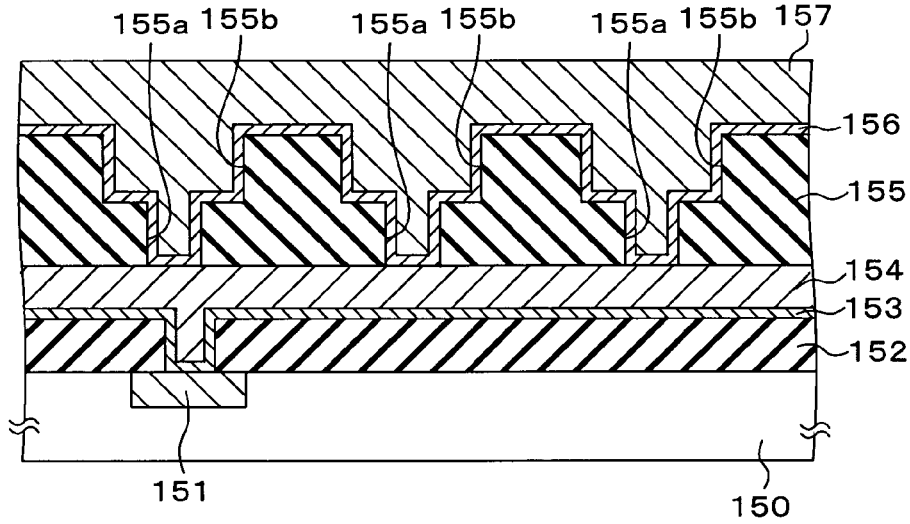

Thence, by use of the sputtering method, the plating method or the CVD method, a copper film 157 is formed on the entire surface of the top on the semiconductor substrate 150, and thus copper is imbedded into the contact holes 155*a* and the grooves 155*b*, as shown in FIG. 19E.

Figure 19F:
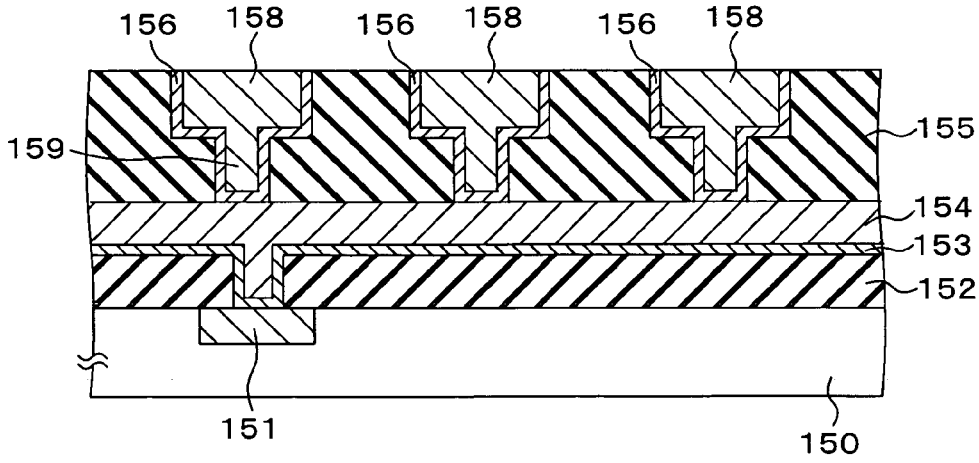

Subsequently, by means of performing CMP polish by use of the polishing machine according to this embodiment, as shown in FIG. 19F, the copper and the barrier layer 156 on the second interlayer insulating film 155 are removed, and thereby the copper is caused to remain only in the grooves 155*b* and the contact holes 155*a*.

While the CMP polish is being performed, a slurry containing an abrasive (abrasive grains) and chemical polishing ingredient is used. For example, a slurry containing an abrasive and an ingredient (for example, an organic acid, such as a citric acid and an oxalic acid) for eluting a material (copper) for interconnects is used. Otherwise, a slurry containing an abrasive and an ingredient (for example, a hydrogen peroxide solution) for oxidizing the material for interconnects is used. If not, a slurry for ionizing and eluting the material (copper) for interconnects (a weakly acidic slurry with a pH in the range of approximately 4 to 5) is used.

In this manner, second interconnects 158 and interconnect connecting parts 159 are simultaneously formed by use of the damascene method using the polishing machine according to the present invention. By use of the aforementioned method, semiconductor devices including copper interconnects can be manufactured with higher yields.

Figure 20A:
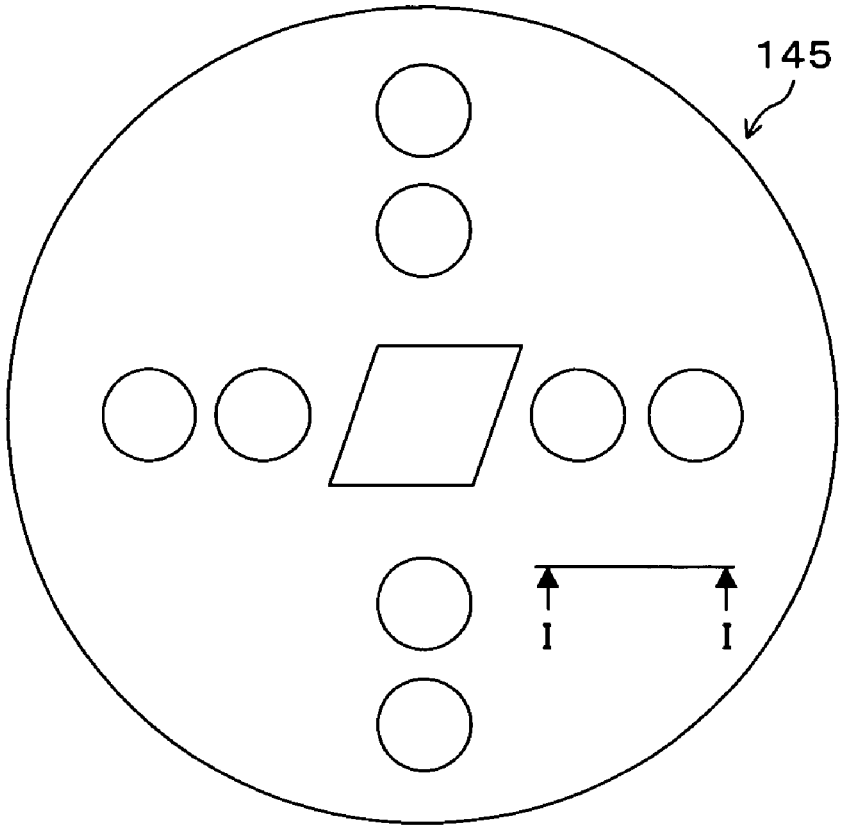
FIG. 20A is a plan view of showing an example of modification of the pedestal pad according to the first embodiment.
Figure 20B:
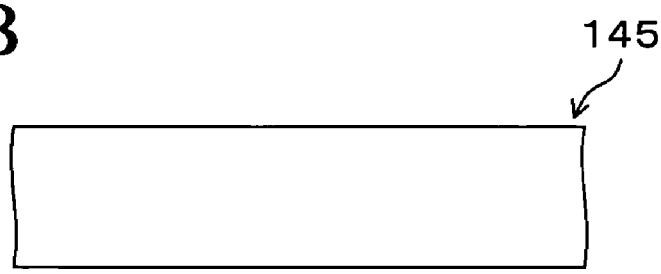
FIG. 20B is a cross-sectional view of the same example.

In the case of this embodiment, the pedestal pad 125 provided with the grooves 125*b* spreading in the radiating manner as shown in FIG. 12 is used. However, a pedestal pad 145 provided with no grooves as shown by a plan view of FIG. 20A may be used. Incidentally, in this case, at least the surface of the pedestal pad 145 which comes into contact with wafers (workpieces) has to be smooth, and the pedestal pad 145 has to have no cavity, such as fine holes, which holds water (a fluid), as shown by FIG. 20B which is a cross section taken along the I—I line of FIG. 20A, either. Considering that an operation which is performed while a wafer is being detached from the pedestal pad is smooth, and that water is efficiently discharged from the pedestal pad, it is advantageous that, like the pedestal pad 125 shown in FIG. 12, a pedestal pad be provided with grooves.

It should be noted that, although the aforementioned example has been described giving the case where copper interconnects are formed by use of the polishing machine according to this embodiment, the polishing machine according to this embodiment can be used for polishing semiconductor wafers, for polishing a film of a metal, such as copper, tungsten, titanium, aluminum, tantalum, silver, gold, platinum and ruthenium, which is formed on semiconductor wafers, for polishing semiconductor films made of polycrystalline silicon, amorphous silicon or the like, and for polishing insulating films made of Si, SiO, $SiO_2$, SiOC, SiC, SiON, SiN, BPSG or the like.

Second Embodiment

Hereinafter, descriptions will be provided for a second embodiment of the present invention. What makes the second embodiment different from the first embodiment is that the pedestal pad arranged on the pedestal in the second embodiment is different from that in the first embodiment. The other basic configuration in the second embodiment is the same as that in the first embodiment is. For this reason, descriptions of parts and components used commonly in the first and second embodiments will be omitted here.

Figure 21A:
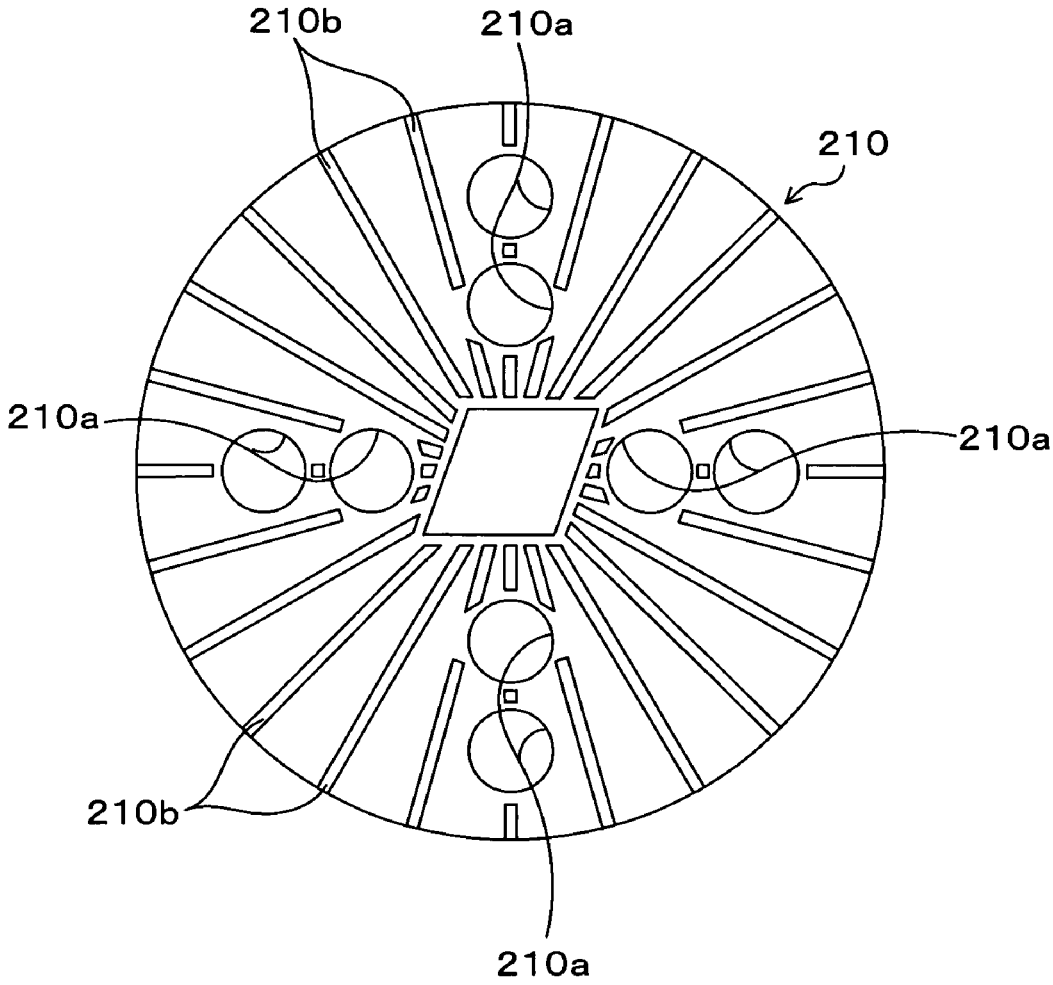
FIG. 21A is a plan view showing a pedestal pad used in a polishing machine according to a second embodiment of the present invention.
Figure 21B:
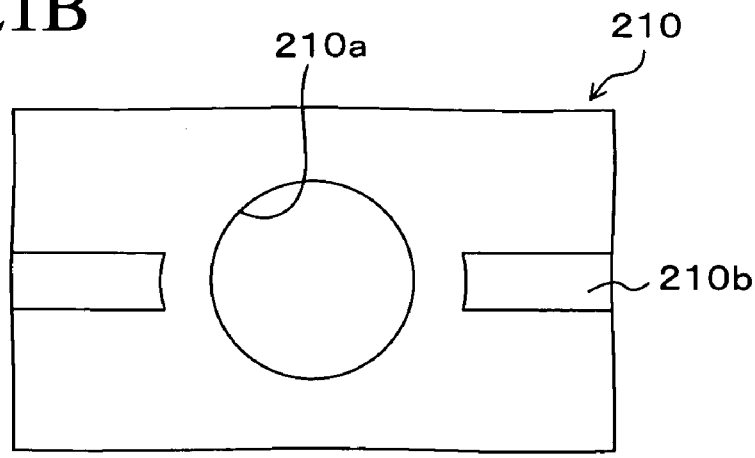
FIG. 21B is a plan view showing the vicinity of one of holes in the same pedestal pad in a magnified manner.

FIG. 21A is a plan view showing a pedestal pad 210 used in a polishing machine according to the second embodiment of the present invention. FIG. 21B is a plan view showing the vicinity of one of holes 210*a* in the same pedestal pad 210 in a magnified manner.

In the case of this embodiment, too, the pedestal pad 210 is formed of a sheet of polyurethane, and at least the surface of the pedestal pad 210 which comes into contact with a wafer is non-absorbable to a fluid. In other words, the surface of the pedestal pad 210 (the surface which comes into contact with the wafer) is smooth, and does not have any cavity, such as fine holes, which holds water (a fluid). Furthermore, in the case of this embodiment, too, grooves 210*b* spreading in a radiating manner are formed in the pedestal pad 210.

Figure 22:
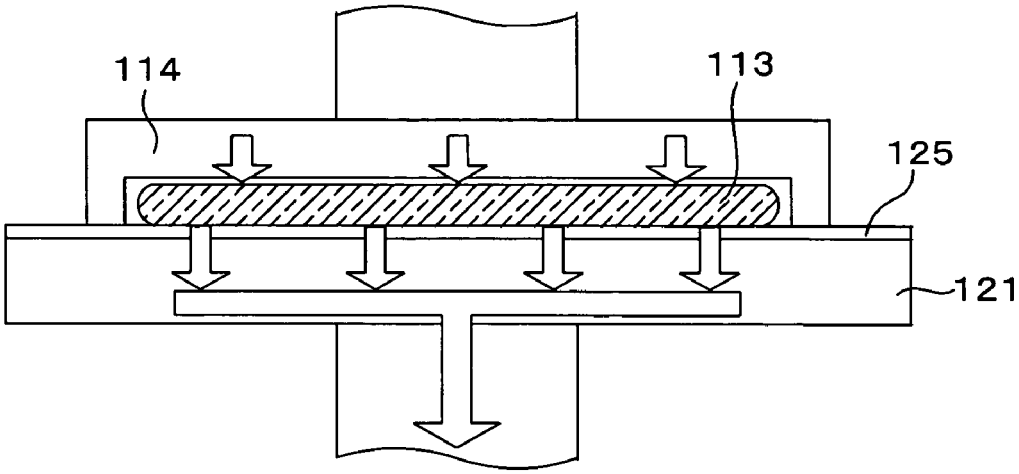
FIG. 22 is a schematic diagram showing a condition which occurs when a wafer is being detached (dechucked) from a polishing head.

In the pedestal pad according to the first embodiment (see FIG. 12), the grooves 125*b* are connected with the holes 125*a*. For this reason, while the wafer 113 is being detached (dechucked) from the polishing head 114, air flows into the nozzles of the pedestal 121 through the grooves 125*b* as schematically shown in FIG. 22. This is likely to bring about a problem (dechuck error) that the wafer 113 is not fully adsorbed to the top of the pedestal pad 125.

With this taken into consideration, in the case of the second embodiment, clearances (interstices) are provided between the holes 210*a* and the grooves 210*b*, as shown in FIGS. 21A and 21B. By this, no air flows into the nozzles of the pedestal through the grooves 210*b*. This prevents the dechuck error.

In the case of this embodiment, the surface of the pedestal pad 210 (the surface which comes into contact with the wafer) is smooth, and does not have any cavity, such as fine holes, which holds water (a fluid). This makes it possible to inhibit troubles, such as oxidation and corrosion, from occurring on the surface of the wafer (workpiece) from a time of completion of the polish until a time of the unloading, as in the case of the first embodiment.

Third Embodiment

Hereinafter, descriptions will be provided for a third embodiment of the present invention. What makes the third embodiment different from the first embodiment is that the pedestal pad arranged on the pedestal in the third embodiment is different from that in the first embodiment. The other basic configuration in the third embodiment is the same as that in the first embodiment is. For this reason, descriptions of parts and components used commonly in the first and third embodiments will be omitted here.

Figure 23A:
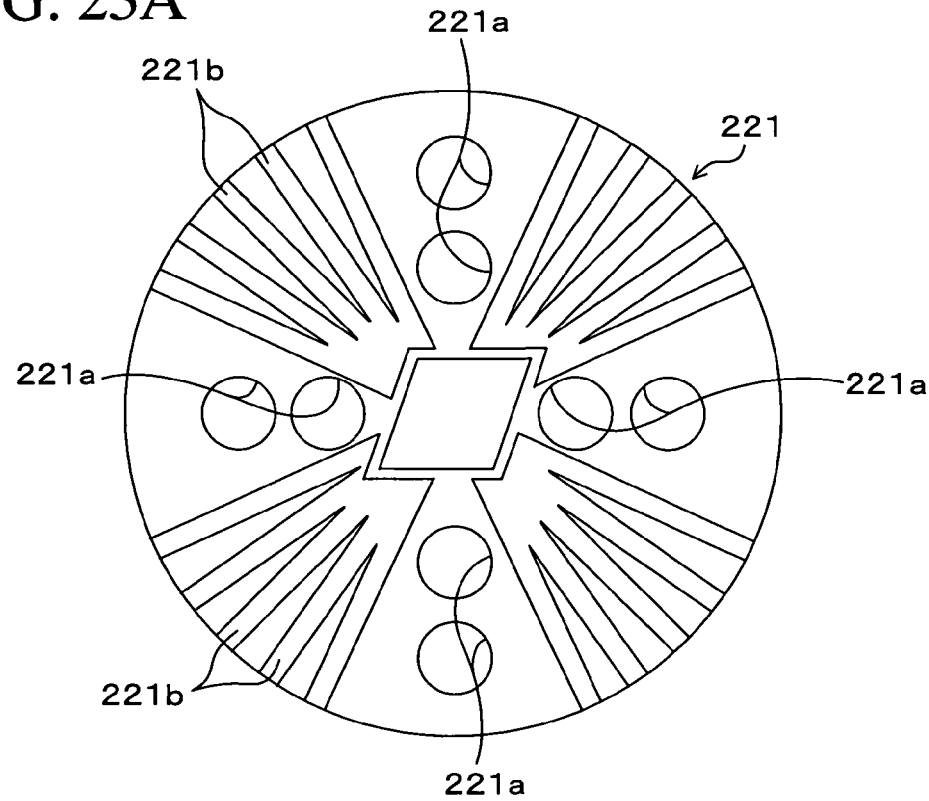
FIGS. 23A and 23B are plan views showing respectively showing pedestal pads used in a polishing machine according to a third embodiment of the present invention.
Figure 23B:
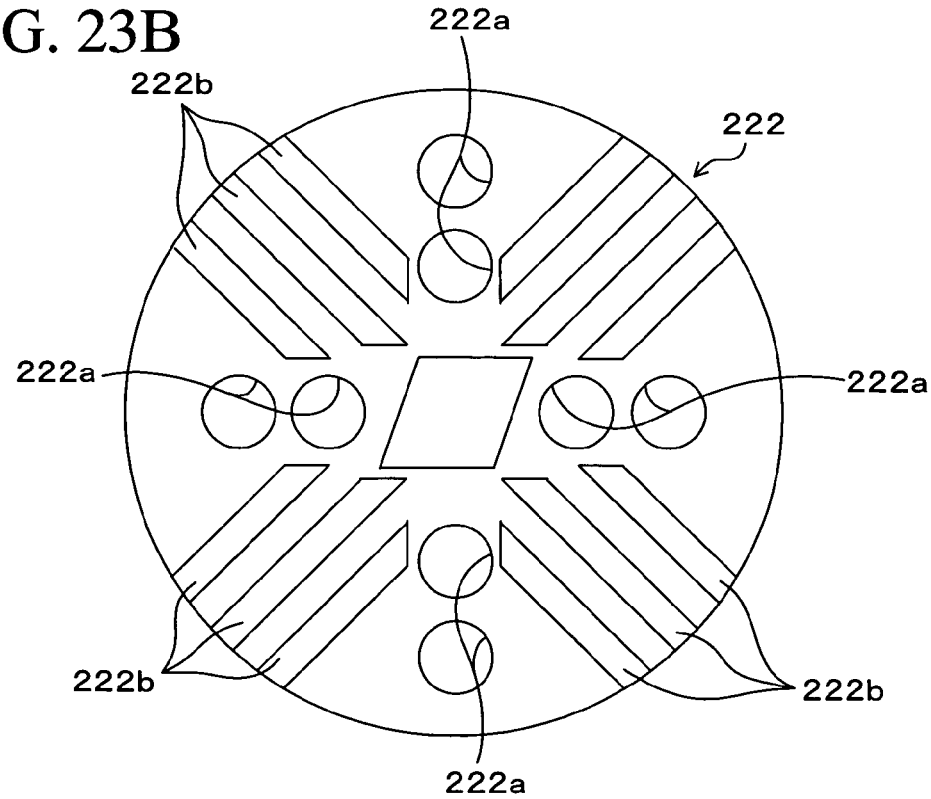

FIGS. 23A and 23B are plan views respectively showing pedestal pads 221 and 222 used in a polishing machine according to the third embodiment of the present invention. In the case of this embodiments, too, the pedestal pads 221 and 222 are made of a sheet of polyurethane, and the surfaces respectively of the pedestal pads 221 and 222 (the surfaces which come into contact with the respective wafers) are non-absorbable to a fluid. Specifically, the surfaces respectively of the pedestal pads 221 and 222 (the surfaces which come into contact with the respective wafers) are smooth, and do not have any cavity, such as fine holes, which hold water (a fluid). In the case of this embodiment, too, the pedestal pad 221 is provided with holes 221*a* corresponding to the nozzles of the pedestal and with grooves 221*b* for discharging water, and the pedestal pad 222 is provided with holes 222*a* corresponding to the nozzles of the pedestal and with grooves 222*b* for discharging water.

The grooves of the pedestal pads are formed, for example, by use of a numerical control (NC) router machine. In this case, with regard to the pedestal pad according to the second embodiment (see FIGS. 21A and 21B), the clearances are provided between the grooves 210*b* and the holes 210*a*. This brings about a problem that control programs of the NC router machine are complicated, and that product costs are accordingly increased.

In addition, another problem is brought about. Details are as follow. The end shape of a router bit for performing a general lateral-directional process which is used in the NC router machine is flat. For this reason, with regard to the pedestal pad according to the first embodiment (see FIG. 12), the grooves can be formed by use of the general router bit starting from the edge of the pad. By contrast, with regard to the pedestal pad according to the second embodiment (see FIGS. 21A and 21B), the grooves are required to be formed starting from positions away from the holes. For this reason, the general router bit whose end is flat in shape can not be used. Consequently, in a case where the grooves of the pedestal pad according to the second embodiment is intended to be formed, a router bit whose end has a specialized shape, and which can grind in the longitudinal direction, is required to be used. However, use of such a router deteriorates the smoothness of the bottom surfaces of the grooves. This makes it difficult to smoothly discharge water inside the grooves. It can be conceived that, after the grooves are formed, a smoothing process is applied to the bottom surfaces of the grooves. In the case of the application, product costs is further increased.

With this taken into consideration, with regard to the pedestal pad 221 according to the third embodiment, the grooves 221*b* are formed in a way that parts including the holes 221*a* are averted, as shown in FIG. 23A. The grooves 222*b* are formed in a way that parts including the holes 222*a* are averted, as shown in FIG. 23B. This makes it possible to avoid a dechuck error and a rise of production costs.

Pedestal pads according to this embodiment were actually manufactured, and the numbers of defects on the respective coppers were checked after the CMP polish is performed, as in the case of the first embodiment. As a result, the numbers of defects were the same as those in the first embodiment were.

Fourth Embodiment

Figure 24A:
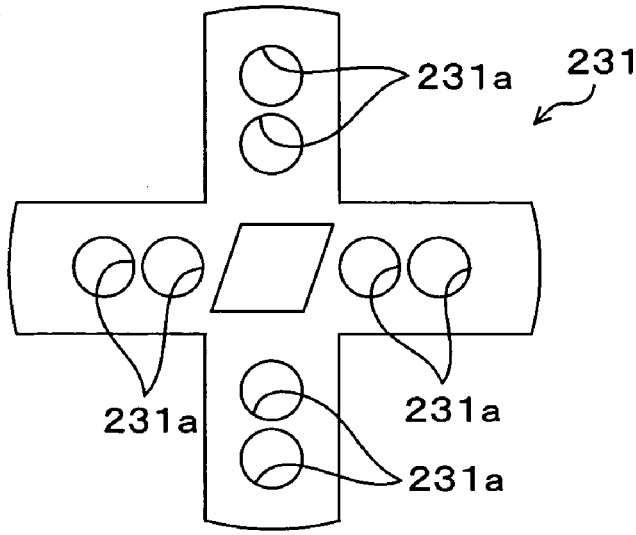
FIGS. 24A and 24B are plan views respectively showing pedestal pads of a polishing machine according to a fourth embodiment of the present invention.
Figure 24B:
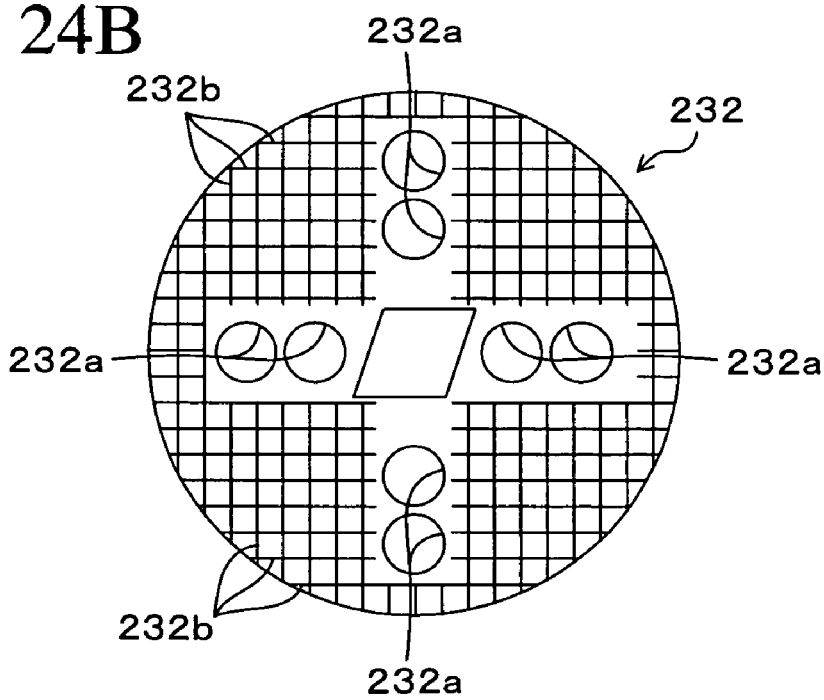

FIGS. 24A and 24B are plan views respectively showing pedestal pads 231 and 232 of a polishing machine according to a fourth embodiment of the present invention.

As described above, in order to prevent problems, such as oxidation and corrosion of a metal, which would occur from a time of completion of the CMP polish until of a time of the unloading, the surface of the pedestal pad (the surface which comes into contact with the wafer) has to be non-absorbable to water (a fluid). In other words, the surface of the pedestal pad (the surface which comes into contact with the wafer) has to be smooth, and has to have no cavity, such as fine holes, which holds water (a fluid). In addition to this, in the case of this embodiment, by means of reducing the area of a surface of the pedestal pad which comes into contact with the wafer, problems, such as oxidation and corrosion of a metal, are securely prevented from occurring.

The pedestal pad 231 shown in FIG. 24A is formed so as to be shaped like a cross, and accordingly the area of a surface of the pedestal pad which comes into contact with the wafer is made smaller. Furthermore, the pedestal pad 232 shown in FIG. 24B is formed so as to be shaped like a circle. However, grooves 232*b* are formed in a matrix in the surface of the pedestal pad 232, and accordingly the area of a surface of the pedestal pad 232 which comes into contact with the wafer is made smaller. Incidentally, the pedestal pad 231 is provided with holes 231*a* at positions corresponding to nozzles of the pedestal, too. As well, the pedestal pad 232 is provided with holes 232*a* at positions corresponding to nozzles of the pedestal.

In the case of this embodiment, the surface of the pedestal pad (the surface which comes into contact with the wafer) is smooth, and does not have any cavity, such as fine holes, which holds water (a fluid). In addition, the area of the surface of the pedestal pad which comes into contact with the wafer is made smaller in the case of this embodiment than in the case of the first embodiment. For this reason, oxidation and corrosion can be securely prevented from occurring in the surface of a post-polished workpiece.

Fifth Embodiment

Hereinafter, descriptions will be provided for a fifth embodiment of the present invention. What makes the fifth embodiment different from the first embodiment is that the pedestal pad arranged on the pedestal in the fifth embodiment is different from that in the first embodiment. The other basic configuration in the fifth embodiment is the same as that in the first embodiment is. For this reason, descriptions of parts and components used commonly in the first and third embodiments will be omitted here.

Figure 25:
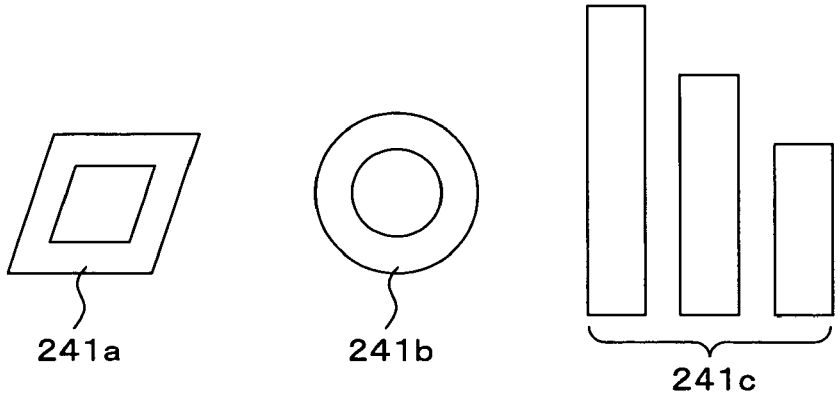
FIG. 25 is a plan view showing pad-constituting members for constituting a pedestal pad of a polishing machine according to a fifth embodiment.
Figure 26:
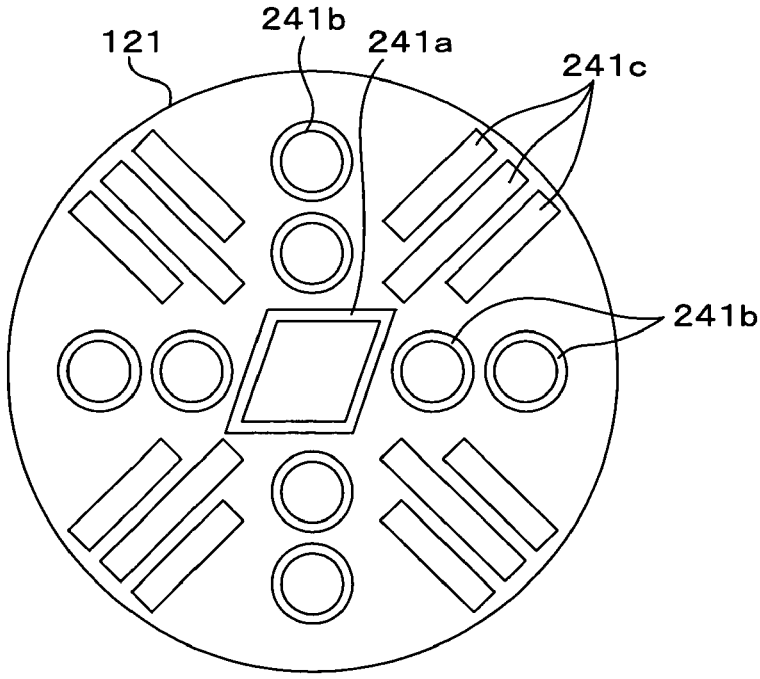
FIG. 26 is a plan view showing a condition in which the pedestal pad is joined to the top of a pedestal according to the fifth embodiment.

FIG. 25 is a plan view showing pad-constituting members for constituting a pedestal pad of a polishing machine according to this embodiment. The pedestal pad according to this embodiment is constituted of a rhombus-shaped pad-constituting member 241*a* and annular (ring-shaped) pad-constituting members 241*b* which correspond to the nozzles of the pedestal as well as rectangular pad-constituting members 241*c*. The pedestal pad is joined to the top of a pedestal 121 as shown in FIG. 26. These pad-constituting members 241*a* to 241*c* are formed by means of removing parts corresponding to the shapes of the pad-constituting members from a sheet made, for example, of polyurethane (or another type of resin). The surfaces of the pad-constituting members have to be smooth, and have to have no cavity, such as fine holes, which hold water (a fluid) (in other words, the pad-constituting members have to be non-absorbable to a fluid). In addition, it is required to include the pad-constituting members 241*a* and 241*b* surrounding the nozzles of the pedestal 121 in order to prevent a dechuck error.

In the case of this embodiment, too, oxidation and corrosion can be securely prevented from occurring in the surface of a post-polished workpiece. This is because the surface of the pedestal pad is smooth, and because the surface accordingly has no cavity, such as fine holes, which hold water (a fluid). In addition, this is because an area of the surface of the pedestal pad which comes into contact with the wafer is designed to be smaller in the fifth embodiment than in the first embodiment.

It should be noted that, as a matter of course, the present invention can be applied to CMP machines each for polishing workpieces other than wafers, although the first to the fifth embodiments have been described giving the case where the present invention is applied to CMP machines each for polishing wafers. Furthermore, the present invention can be applied to polishing machines (polishing machines each including a workpiece supporting table for temporality holding a polished workpiece during the loading/unloading) other than CMP machines.

Sixth Embodiment

A sixth embodiment of the present invention relates to a mode in which a cleaning fluid is sprayed on the polished surface of a wafer so as to clean the polished surface after polishing.

Figure 27:
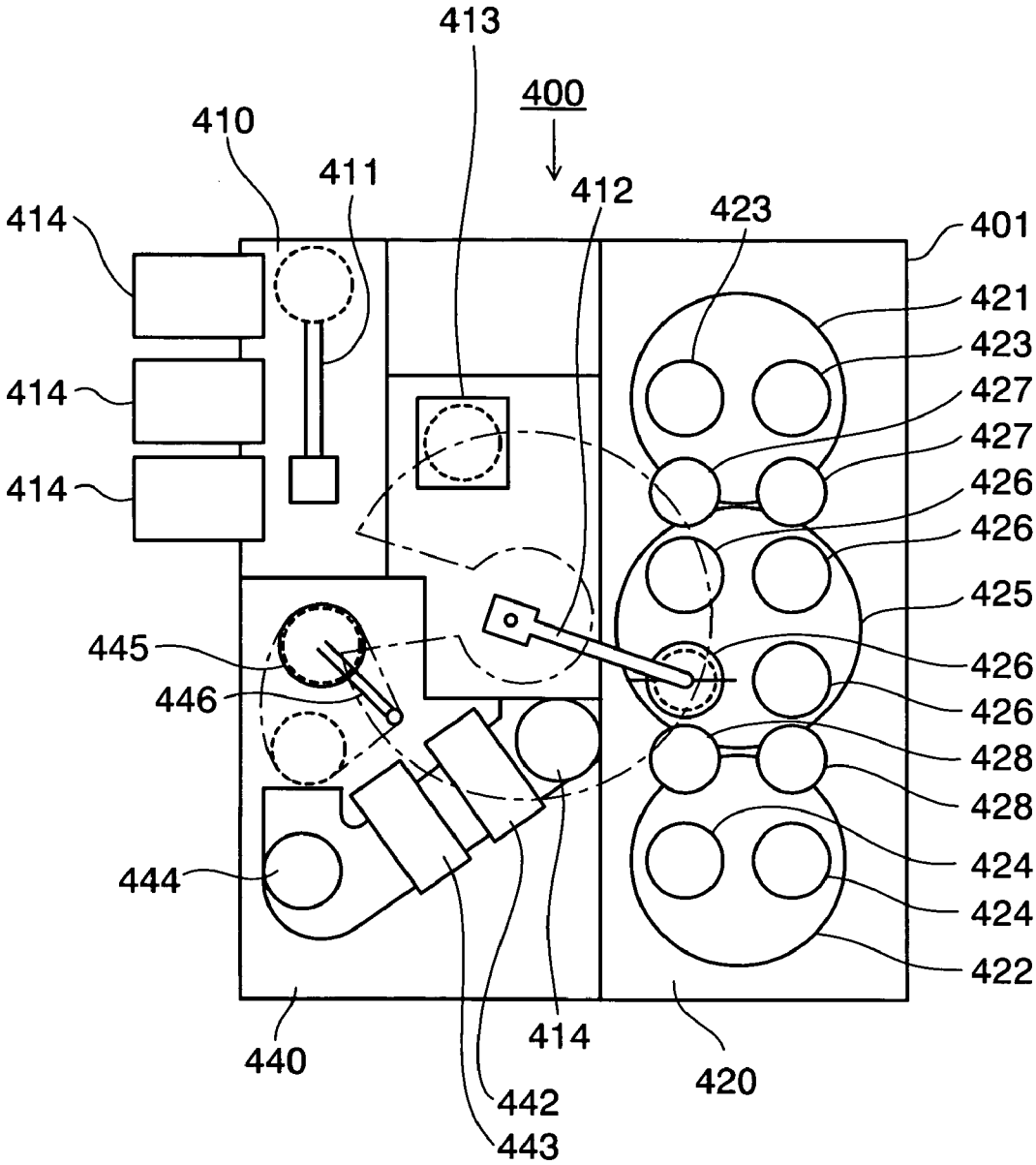
FIG. 27 is a plan view of a polishing machine in a sixth embodiment of the present invention.

FIG. 27 is a plan view of a polishing machine of the present invention, showing a substantial configuration of a polishing machine which combines a polishing unit and a cleaning unit. A polishing machine 400, the whole of which is accommodated in a clean room 401, includes a carry-in/carry-out unit 410 for carrying a wafer in the clean room 401 or carrying out of the clean room 401, a polishing unit 420 for polishing the wafer by CMP, and a cleaning unit 440 for cleaning the wafer. The units are separated from each other so that an airflow between the units will be less in order to maintain a clean atmosphere in each unit.

On the carry-in/carry-out unit 410, a cassette 414 for accommodating the wafer before and after polishing is mounted. A robot arm 411 is also provided for taking the wafer out of the cassette 414 or accommodating the wafer in the cassette 414.

The polishing unit 420 has two platens 421 and 422, and a turntable 425 is provided therebetween. An abrasive pad is attached to the top surface of the platens 421 and 422 so as to supply slurry. Also, two polishing heads 423, 424 are provided for each of the platens 421 and 422, and the wafer held on the bottom of the heads 423 and 424, is polished by being pressed against the abrasive pad. The heads 423 and 424 are movable vertically relative to the sheet of FIG. 27.

A turntable 425, which has four placing tables 426 on the top surface thereof, is turned to carry a wafer placed on a placing table 426.

Furthermore, the wafer placed on the placing table 426 can be cleaned with a cleaning fluid.

In addition, between the turntable 425 and the platen 421, and between the turntable 425 and the platen 422, cleaning stages 427 and 428 for cleaning the wafer are provided respectively. The cleaning stages 427 and 428 rotatingly travel from the position shown in FIG. 27 to the position of the placing table 426 and can carry the wafer between the positions.

The cleaning unit 440 includes two cleaners 442 and 443, stages 441 and 445 for carrying-in and for carrying-out, a drier 444, and a robot arm 446 for carrying a wafer rotatingly.

The wafer is taken out of the cassette 414 by the robot arm 411, and then placed on a thicknessmeter 413 as a point of delivery. The wafer placed on the thicknessmeter 413 is carried in the polishing unit 420 by the robot arm 412, and then placed on the placing table 426 provided in the polishing unit 420.

The wafer placed on the placing table 426 is adsorbed on the bottom of either of the heads 423 or 424, carried to the top surface of the platens 421 and 422 by the travel of the heads 423 and 424. The wafer is then pressed against the abrasive pad on the top surface of the platens 421 and 422 at that position, and then polished.

The polished wafer is carried to the cleaning stage 428 by the travel of the heads 423 and 424, cleaned there, and then placed on the placing table 426.

Next, after carrying the wafer placed on the placing table 426 to the thicknessmeter 413 followed by measuring its thickness, the robot arm 412 places the wafer on the placing table 426 again. Then, using the platen different from the one used for the previous polishing, the wafer is finish-polished and brought back to the placing table 426 through the cleaning stage.

The finish-polished wafer is placed on the stage 441 in the cleaning unit 440 by the robot arm 412. After being carried to the drier 444 through the cleaner 442 for main cleaning and the cleaner 443 for finish cleaning and then dried, the finish-polished wafer is placed on the stage 445 by the robot arm 446.

The wafer placed on the stage 145 is accommodated by the robot arm 411 again in the cassette 414 for accommodating the wafer. Thus, the polishing machine, in which all the polishing steps are automatically taken, can achieve a dry-in/dry-out process without manual operations during the process.

FIGS. 28A to 28D are figures for illustrating an operation of the polishing machine of the sixth embodiment according to the present invention, showing the platen and a main mechanism provided therearound by cross-sectional views.

A polishing machine used in this embodiment has a nozzle 466 for spraying a cleaning fluid near the periphery of a platen 461 (the platen 421 or 422 in FIG. 27), and controls the position and spray direction of a nozzle opening 466*a* by a nozzle controlling means. It should be noted that any nozzle controlling means is applicable as long as it is a mechanism which can control the position of the nozzle opening 466*a* and the spray direction of the cleaning fluid. A mechanistically-configured one as a whole such as a traveling and rotating mechanism for the position and the direction of the nozzle 466 is applicable and a mechanism controlled by a computer, for example, a robot is also applicable.

On the platen 461 of the machine, an abrasive pad 462 is attached, and the platen 461 is rotatingly driven around a rotation axis 461*a*. A wafer 464, whose periphery is pressed by a ring-shaped retainer 465*b*, is held on the bottom of the head 465. Therefore, the wafer 464 is pressed against the abrasive pad 462 by the head 465 and polished by CMP. Also, slurry (abrasive) is supplied on the abrasive pad 462.

Figure 28A:
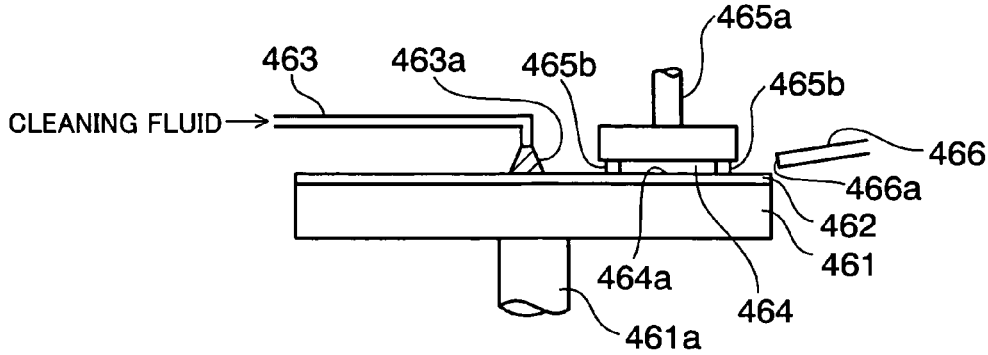
FIGS. 28A to 28D are figures for illustrating an operation of the polishing machine in the sixth embodiment of the present invention.

Next, as shown in FIG. 28A, when polishing by CMP finishes, the pressure (polishing pressure) by the head 465 is released, and the wafer 14 is held by being adsorbed on the bottom of the head 465. At the same time, the supply of slurry is stopped, and pure water is sprinkled on the abrasive pad 462 from a shower 463 as a cleaning fluid 463*a* instead.

Figure 28B:
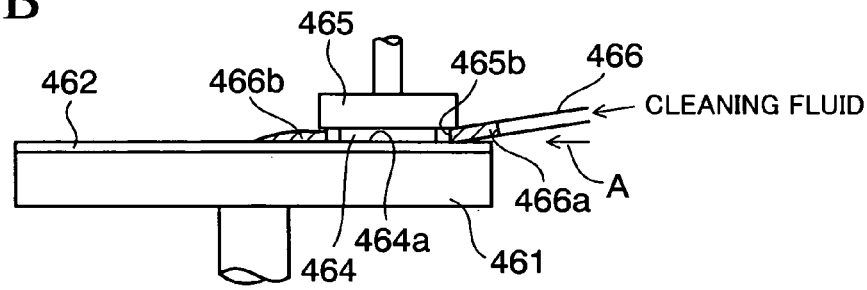

Next, as shown in FIG. 28B, the nozzle 466, which has been evacuated to the outside of the platen 461, travels along a traveling direction A toward the center of the platen 461 so that the nozzle opening 466*a* is positioned on the abrasive pad 462. In this case, the position and nozzle angle of the nozzle opening 466*a* are adjusted so that a cleaning fluid 466*b* sprayed from the nozzle opening 466*a*, pure water, for example, is applied on the outer surface of the retainer 465*b* and the exposed surface adjacent to the outside of the retainer 465*b* on the abrasive pad 462. Therefore, the cleaning fluid 466*b* flows on the abrasive pad 462, covering the outside of the retainer 465*b* put on the abrasive pad 462 in contact. Consequently, the polished surface 464*a* of the wafer 464 held inside the retainer 465*b* is not exposed to an atmosphere.

The flow volume of the cleaning fluid 466*b* in this case, from the standpoint of decreasing residual slurry, is preferably large. At the same time, since the flow rate of spraying does not contribute to cleaning slurry so much as the flow volume does, the flow volume is preferably set as large as possible. Consequently, it is preferable to avoid providing a mechanism for reducing the flow volume, in the nozzle 466, such as an orifice or shower opening for increasing the flow rate, and to employ a nozzle having almost the same cross sectional area throughout the length of the nozzle 466 so as to prevent the flow volume from decreasing.

Figure 28C:
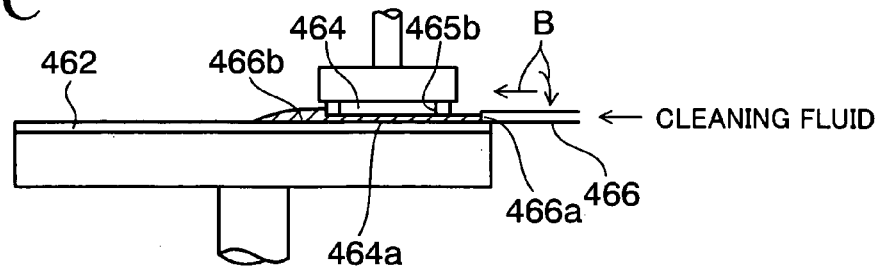

Next, as shown in FIG. 28C, when the head 465 rises thereby forming a slight interstice between the abrasive pad 462 and the polished surface 464*a*, the nozzle 466 travels and rotates along a traveling and rotating direction B so as to make the nozzle opening 466*a* closer to the retainer 465*b*. The nozzle 466 rotates so that the axis thereof is almost in a horizontal position to make the spray angle (specifically, the angle made between the spray direction of the cleaning fluid 466*b* sprayed from the nozzle opening 466*a* and the surface of the abrasive pad 462) smaller. Since a large volume of the cleaning fluid 466*b* flows into the interstice between the abrasive pad 462 and the polished surface 464*a* in the result, the interstice can be filled with the polishing fluid 466*b* completely even if the interstice becomes larger.

The period when the nozzle 466 is traveling and rotating along the traveling and rotating direction B has to come before the time when the interstice becomes so large that the interstice cannot be filled with the cleaning fluid 466*b* which would have been sprayed on the surface of the abrasive pad 462 without such a traveling/rotation. The nozzle 466 travels and rotates along the traveling and rotating direction B so that the cleaning fluid 466*b* of a volume large enough to fill the enlarged interstice can be sent to the interstice. Without such a rotation/traveling, the interstice is not filled with the cleaning fluid, and the polished surface 464*b* is exposed to an atmosphere, thereby corroding the wiring metal.

At the same time, if the spray angle becomes smaller, since the polishing fluid 466*b* interrupted by the surface of the abrasive pad 462 increases, the effective flow volume decreases thereby decreasing the cleaning effect. Therefore, it is preferable that making the spray angle smaller be conducted at a late timing. However, since the relation between the spray angle of the cleaning fluid 466*b* and the size of the interstice with which the cleaning fluid 466*b* is filled significantly varies with the wettability, traveling speed and the like of the abrasive pad 462 or polished surface 464*a*, the timing of traveling/rotating the nozzle 466 has to be determined optimally based on the experiments.

Figure 28D:
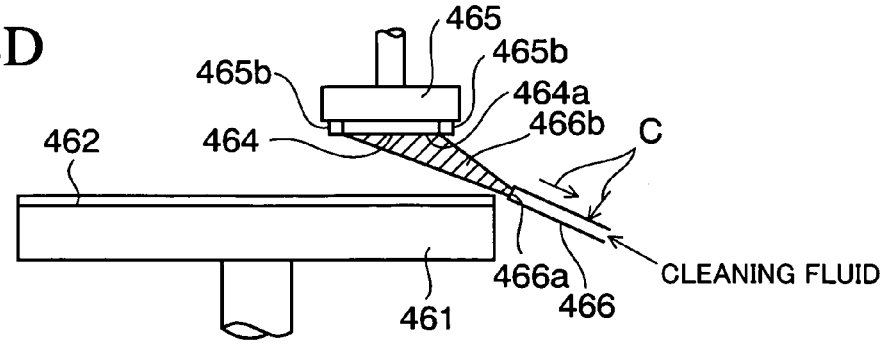

Next, as shown in FIG. 28D, during the period when the head 465 continues rising up to a prescribed position (cleaning position), the position of the nozzle opening 466*a* and the direction of the nozzle 466 are controlled so that the cleaning fluid 466*b* continues being sprayed on the polished surface 464*a*. For example, when the rise amount of the head 465 is small, the nozzle 466 is controlled so that the nozzle opening 466*a* is positioned close to the head and at a slightly upward spray angle. This enables the cleaning fluid 466*b* to be sprayed on the polished surface 464*a* even though the rise amount of the head 465 is small. As the rise amount of the head 465 becomes larger, the position and direction of the nozzle 466 is controlled so that the nozzle opening 466*a* moves back (direction toward outside of platen 461) with the head along the traveling and rotating direction C and at an upward spray angle at the same time. The nozzle 466 is controlled to follow the polished surface 464*a*, which continues rising, and to spray the cleaning fluid 466*b* thereon.

It is preferable that the abovementioned volume of the cleaning fluid 466*b* sprayed from the nozzle 466 after polishing increase and decrease in stages or gradually for each step in FIGS. 28B and 28C or during the period of taking theses steps, from the standpoint of covering the polished surface 464*a* with a minimum volume of the cleaning fluid 466*b*.

Furthermore, in a step taken before the spray angle becomes negative (spray direction directed upward), for example, in the steps shown in FIGS. 28B and 28C, the spray direction of the cleaning fluid 466*b* within the abrasive pad 462 is preferably oriented in a direction along the rotating direction of the platen 461. This suppresses the turbulence of the cleaning fluid 466*b*, and a large volume of the cleaning fluid 466*b* can flow into the interstice between the abrasive pad 462 and the polished surface 464*a*.

Next, after raising the head 465 up to a prescribed position (cleaning position), the cleaning fluid 466*b* is sprayed for cleaning on the polished surface 464*a* of the wafer 464 held on the bottom of the head 465 successively, and the wafer 464 is carried to the following stage, for example, cleaning stages 427, 428 or placing table 426 shown in FIG. 27. Subsequently, the same steps are taken as in the conventional polishing method, and the polishing process of the wafer 464 is completed.

Seventh Embodiment

Figure 29:
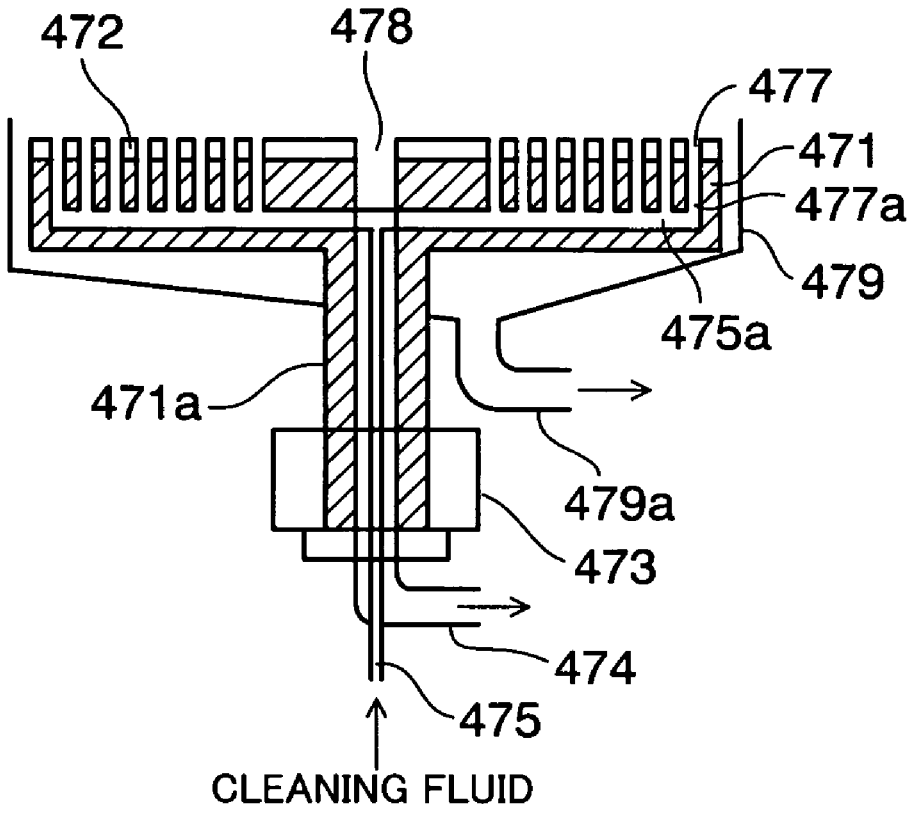
FIG. 29 is a cross-sectional view of a platen in a seventh embodiment of the present invention.
Figure 30A:
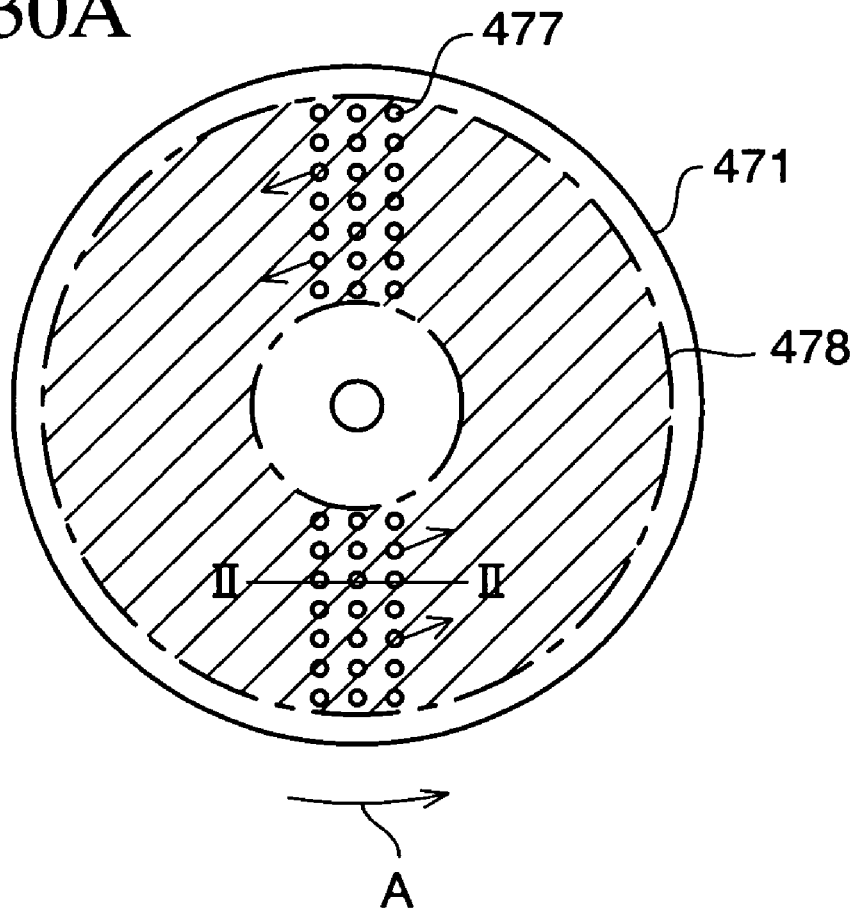
FIGS. 30A and 30B are explanatory drawings of a discharge port in the seventh embodiment of the present invention.
Figure 30B:
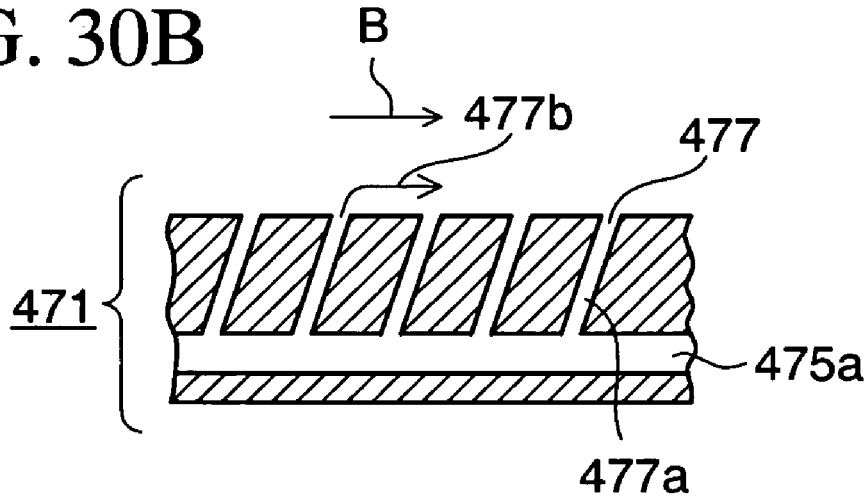

A seventh embodiment of the present invention relates to a polishing machine which has a discharge port for a cleaning fluid on the top surface of a platen. FIG. 29 is a cross-sectional view of the platen in the seventh embodiment of the present invention. FIGS. 30A and 30B are explanatory drawings of a discharge port in the second embodiment of the present invention. FIG. 30A is a plan view showing the arrangement of the discharge ports which open on the platen top surface and FIG. 30B is a cross-sectional view taken along the II—II line of FIG. 30A, showing a cross-sectional shape of the discharge port.

As shown in FIG. 29, a platen 471 according to the seventh embodiment has discharge ports 477 on the top surface thereof. These discharge ports 477, as shown in FIG. 30A, are arranged almost on the whole surface of the platen 471 except on the central part and outer peripheral part of the platen 471.

As shown in FIG. 29, an abrasive pad 472 is adhered on the platen 471, and an opening is provided at the position of the discharge port 477 on the abrasive pad 472. Therefore, the opening and the discharge port 477 communicate with each other, and a cleaning fluid 477*b* discharged from the discharge port 477, without being interrupted, passing through the opening on the abrasive pad 472, is sprayed out on the abrasive pad 472.

The platen 471 and a rotation axis 471*a* rotatingly driven by a rotating and driving mechanism 473 are formed integrally. In the rotation axis 471*a*, an inlet pipe 475 for introducing the cleaning fluid to the center, and a drain pipe 474 surrounding the outside of the inlet pipe 475 are provided. Inside the platen 471, a water channel 475*a* arranged radially from the center is formed, and the upper end of the inlet pipe 475 is connected to the leading edge of the water channel 475*a* on the center side so as to communicate with each other.

The water channel 475*a* communicates with a discharge pipe 477*a* passing through up to the top surface of the platen 471, and the opening above the discharge pipe 477*a* composes the discharge port 477. Therefore, the cleaning fluid introduced from the lower portion of the inlet pipe 475 rising through the inlet pipe 475, by way of the water channel 475*a*, is supplied to each discharge pipe 477*a*. Through the discharge pipe 477*a*, the cleaning fluid is discharged from the discharge port 477 to the top surface of the abrasive pad 472.

The cleaning fluid discharged to the top surface of the abrasive pad 472 flows on the abrasive pad 472, and further flows into a cup 479 provided outside the platen 471 and into a drain outlet 478 opened at the center of platen 471. The cleaning fluid flowing into the cup 479 is discharged from a drain 479*a* provided at the bottom thereof. Also, the cleaning fluid flowing into the drain outlet 478 is discharged through the drain pipe 474 opened at the bottom of the drain outlet 478.

As shown in FIG. 30B, the discharge pipe 477*a* is provided to be inclined along the traveling direction of the platen 471 (specifically, rotating direction) so that the discharge port 477 is positioned in the traveling direction relative to the bottom of the discharge pipe 477*a*. Since the cleaning fluid 477*b* is fluently discharged along the rotating direction in the result, the flow of the cleaning fluid 477*b* is less turbulent on the top surface of the abrasive pad 472. Consequently, little contamination is involved, thereby achieving clean cleaning.

Next, based on the wafer polishing process using the polishing machine of the second embodiment, a description is given of the operation of the polishing machine according to this embodiment.

Figure 31A:
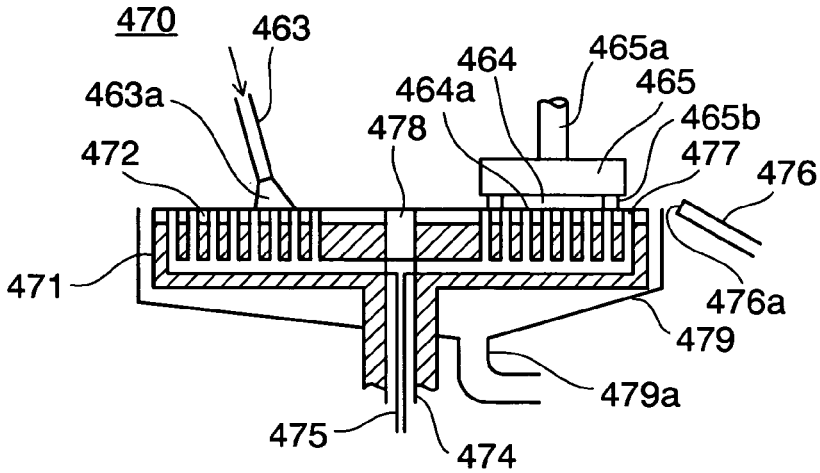
FIGS. 31A to 31C are cross-sectional process drawings illustrating an operation in the seventh embodiment of the present invention.
Figure 31B:
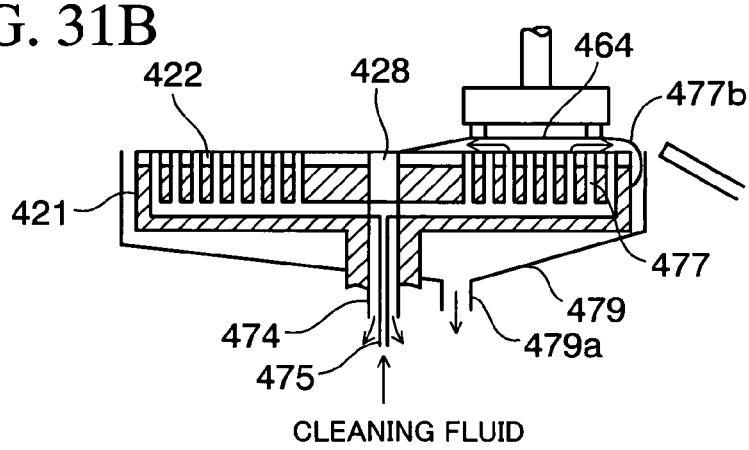
Figure 31C:
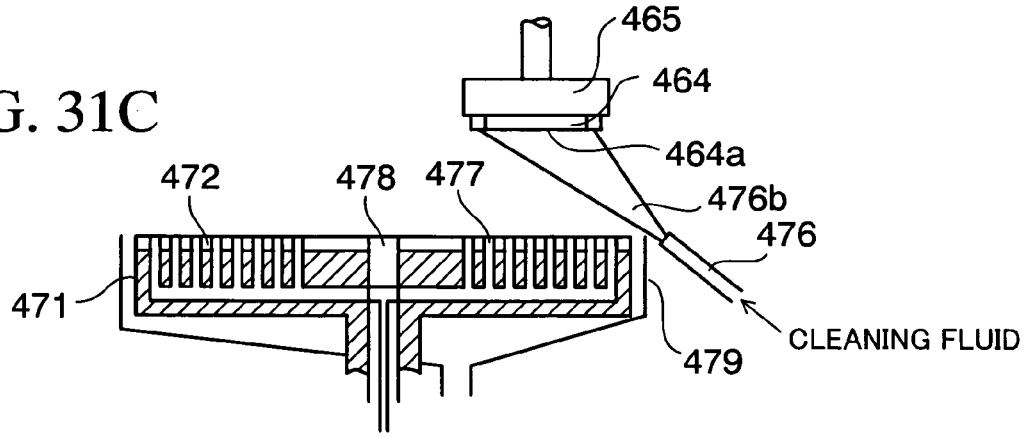

FIGS. 31A to 31C are cross-sectional process drawings illustrating the operation of the seventh embodiment according to the present invention. Referring to FIGS. 31A to 31C, a head 465 for holding a wafer 464 by a retainer 465*b* and a shower 463 for sprinkling a cleaning fluid 463*a* on the top surface of the abrasive pad 472 are the same as in the above described polishing machine in the sixth embodiment.

This polishing machine 470 includes a platen 471 and a cup 479 shown in FIG. 29. Furthermore, a nozzle 476 for spraying the cleaning fluid near the periphery of the platen 471, for example, at a position adjacent to the outside of the platen 471 or at the periphery of the cup 479 is provided. It should be noted that the nozzle 476 is not an indispensable component in the seventh embodiment of the present invention and there is no inconvenience without the nozzle 476.

First, as shown in FIG. 31A, a wafer 464*a* is pressed on the abrasive pad 472 to which an abrasive is supplied by the head 465 for polishing. The polishing pressure is released immediately after the end of polishing and pure water is supplied on the abrasive pad 472 from the shower 463 as the cleaning fluid 463*a*. The abrasive on the abrasive pad 472 is then cleaned at the same time. The steps so far are the same as the steps in the above sixth embodiment.

Next, the head 465 slidingly travels close to the nozzle opening 476*a* on the platen 471. Then, as shown in FIG. 31B, pure water is introduced from the lower end of the inlet pipe 475 as a cleaning fluid, and the cleaning fluid 477*b* (pure water) is discharged from the discharge port 477 toward the bottom of the wafer 464 (polished surface 464*a*). The pressure of the discharge cleaning fluid 477*b* pushes up the wafer 464, thereby forming an interstice between the polished surface 464*a* and the abrasive pad 472. The discharged cleaning fluid 477*b* flows through the interstice to reach the top surface of the abrasive pad 472 appearing outside of the retainer 465*b* holding the periphery of the wafer 464. Furthermore, the cleaning fluid 477*b* flows into the drain outlet 478 opened at the center of the platen 471 and the cup 479 surrounding the periphery thereof, and is discharged from the drain pipe 474 and the drain 479*a*.

In this state or in a state that the head 465 is raised so that the discharged cleaning fluid 477*b* forms a slight interstice (for example, 1 cm interstice) large enough to touch on the polished surface 464*a*, the cleaning fluid 477*b* is discharged from the discharge port 477 so as to clean the polished surface 464*a*. By thus providing a slight interstice, a larger volume of cleaning fluid 477*b* can be discharged toward the polished surface 464*a* compared with a case in which the head 465 is not raised, thereby removing the slurry (abrasive) left on the polished surface 464*a* immediately and reliably.

If the interstice is too large, the cleaning fluid 477*b* has to be discharged at a high speed so that the cleaning fluid 477*b* might reach the polished surface 464*a*. Therefore, the flow volume of the discharged cleaning fluid 477*b* decreases, thereby degrading the cleaning capacity. If too small in contrast, the watercourse of the cleaning fluid 477*b* becomes narrower. If the supply pressure of the polishing fluid 477*b* is low, it becomes difficult to flow a large volume of the cleaning fluid 477*b*, thereby degrading the cleaning capacity. Therefore, the interstice between the polished surface 464*a* and the abrasive pad 472 is preferably 5–15 mm, for example, from the standpoint of being capable of flowing a large volume of the polishing fluid 477*b* at a low supply pressure.

Next, as shown in FIG. 31C, the head 465 is raised up to a prescribed cleaning position and the cleaning fluid 476*b* is sprayed from the nozzle 476 toward the polished surface 464*a* so as to clean the polished surface 464*a*. Next, the wafer 464 is carried to a stage of the following process (for example, cleaning stages 427, 428 or placing table 426 shown in FIG. 27), and CMP process is finished. It should be noted that the step of raising the head 465 up to a prescribed cleaning position for cleaning could be omitted.

In the above seventh embodiment, the discharge ports 477 are formed almost on the whole surface of the platen 471. The discharge ports 477 can be formed only at a prescribed position on the platen 471, for example, at a position of the head 465 suitable for cleaning by using the nozzle 476. For example, when the head 465 travels to a prescribed position on the top surface of the platen 471, the discharge port 477 is provided only in a region positioned right below the wafer 464. Since this can limit the discharge region of the cleaning fluid 477*b* to right below the wafer 464, the cleaning fluid 477*b* which does not contribute to cleaning the wafer 464 can be reduced, thereby improving the efficiency of utilizing the cleaning fluid.

Also in the seventh embodiment, the nozzle 476 is fixed so that the cleaning fluid 476*b* is sprayed on the polished surface 464*a* of the wafer 464 held at a prescribed cleaning position. The nozzle of the sixth embodiment may be employed instead of the nozzle 476. It should be noted that, in the sixth and seventh embodiments, the head 465 is preferably rotated during the step of cleaning the polished surface 464*a* in order to clean the entire polished surface 464*a* with the cleaning fluids 466*b*, 477*b* and 476*b*.

Although the discharge pipe 477*a* is inclined in this embodiment, the discharge pipe 477*a* may be provided vertically on the top surface of the platen 471. In this case, the cleaning fluid may be sprayed from the discharge port 477. The polished surface 464*a* is cleaned with the cleaning fluid continuously in a state that the head 465 is raised up to a traveling position to the following step. In this case, the nozzle 476 may be omitted.

Eighth Embodiment

An eighth embodiment of the present invention relates to a polishing machine which soaks a platen in a cleaning fluid.

Figure 32A:
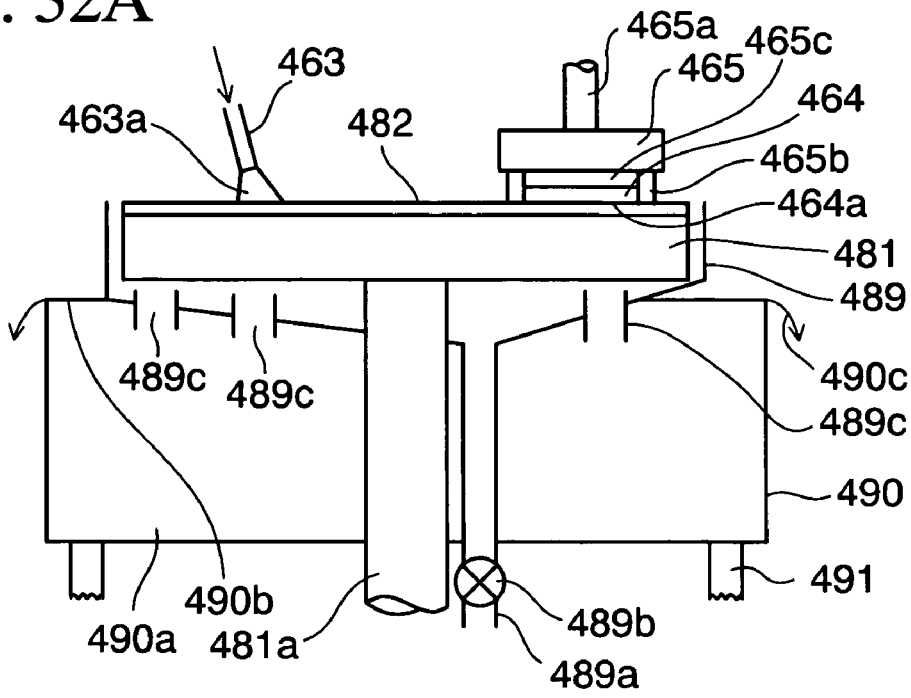
FIGS. 32A and 32B are cross-sectional process drawings illustrating an operation in an eighth embodiment of the present invention.
Figure 32B:
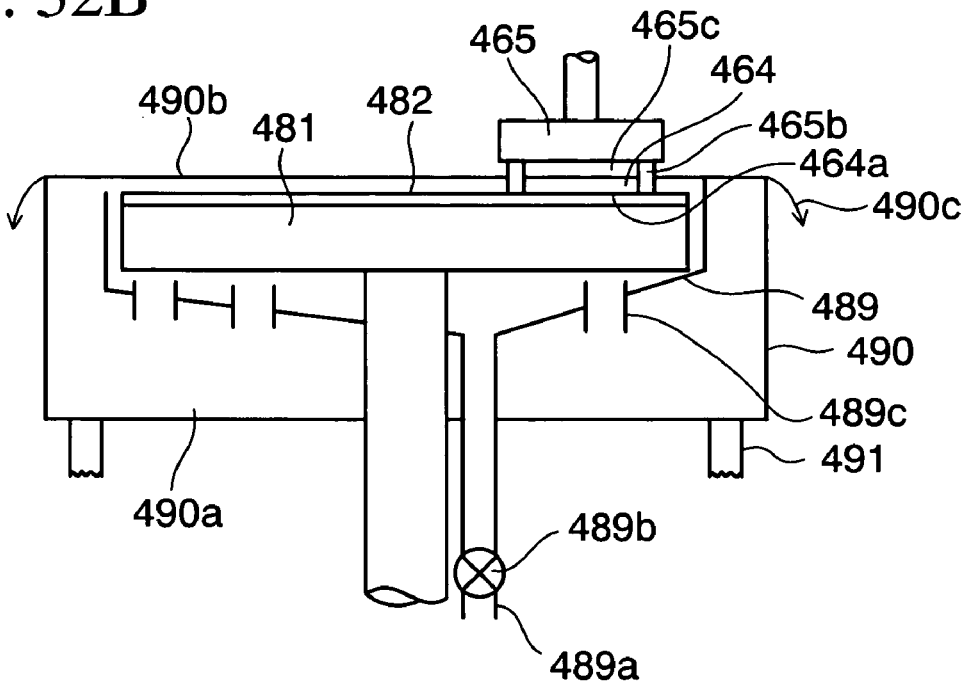

FIGS. 32A and 32B are cross-sectional process drawings illustrating the operation of the third embodiment according to the present invention, showing the polishing process by way of a cross section of a substantial part of the polishing machine.

As shown in FIG. 32A, the polishing machine according to the third embodiment includes a water tank 490 for holding a cleaning fluid 490*a* by making it overflow below a platen 481 (490*c* denotes a overflowing cleaning fluid in the figure). The water tank 490, which is movable vertically by an elevating mechanism 491, can soak an abrasive pad 482 on the top surface of the platen 481 in the cleaning fluid 490*a* when the water tank 490 is raised.

In a cup 489 for collecting slurry flowing out to the outside of the platen 481, a communicating pipe 489*c* and a drain 489*a* are provided on the bottom thereof. In the drain 489*a*, a valve for opening and closing the drain 489*a* is provided. The communicating pipe 489*c*, which is composed of a short tube-shaped opening, is formed so that its upper end is slightly lower or slightly higher than the overflow surface in the water tank 490.

The platen 481 to whose top surface the abrasive pad 482 is attached and a head 465 for holding a wafer 464 on the bottom thereof are the same as in the above polishing machine according to the sixth embodiment. It should be noted that a pressure pad inserted between the wafer 464 held in the retainer 465*b* and the head 465. The pressure pad is a bag of an elastic body and presses against the back surface of the wafer 464 pneumatically. The pressure pad is omitted in the description of the head of the above embodiments.

Hereinafter, a description is given of the polishing process of the eighth embodiment. First, as shown in FIG. 32A, the water tank 490 is lowered and a cleaning fluid 490*a* (for example, pure water) is filled in the water tank 490 until it overflows. In this case, a cleaning fluid surface 490*b* is held at a position in no contact with the bottom of the platen 481. The cleaning water 490*a*, when the height of the upper end of the communicating pipe 489*c* is lower than the overflowing cleaning fluid surface 490*b*, flows into the cup 489 through the communicating pipe 489*c*. The cleaning water 490*a* flown into the cup 489 is discharged through the opened valve 489*b* from the drain 489*a*.

In this state, slurry is supplied on the abrasive pad 482 and the CMP of the wafer 464 is performed. After polishing by CMP, the supply of slurry is stopped and the pressure pad 465*c* is depressurized at the same time, and a cleaning fluid 463*a* (for example, pure water) is discharged on the abrasive pad 482 by the shower 463 so as to perform the so-called water polishing. In these steps, the slurry and cleaning fluid 463*a* flow on the top surface of the abrasive pad 482 and further flows into the cup 489 from the periphery of the platen 481. The slurry and cleaning fluid 463*a* are then discharged from the drain.

Next, the cleaning fluid 463*a* is stopped and the wafer 464 is held by being adsorbed to the head 465. At the same time, the water tank 490 is raised so that the platen 481 and the abrasive pad 482 are soaked in the cleaning fluid 490*a* held in the water tank 490 as shown in FIG. 32B. Almost simultaneously with the rise of the water tank 490, the valve 489*b* is closed. It should be noted that the valve 489*b* may be closed later than the rise of the water tank 490. The slurry left in the cup 489 from the drain 489*a* together with the cleaning fluid 490*a* flowing from the inside of the water tank 490 into the cup are discharged, thereby suppressing the contamination of the cleaning fluid 490*a* in the water tank 490.

In the step of raising the water tank 490, the cleaning fluid flows into the cup 489 through the communicating pipe 489*c*, and the cleaning fluid surface 490*b* in the cup 489 and the overflowing cleaning fluid surface 490*b* in the water tank 490 are the same in height.

In this case, the position of the water tank 490 is controlled in order that the cleaning fluid surface 490*b* is in a position where a part of the retainer 465*b* is soaked in the cleaning fluid 490*a*. In this position, since the side face of the head 465 is not soaked in the cleaning fluid 490*a*, the cleaning fluid 490*a* can avoid being contaminated by the contamination adhered to the head 465 during polishing.

Next, raising the head 465 and leaving the polished surface 464*a* soaked in the cleaning fluid 490*a*, an interstice is formed between the polished surface 464*a* and the top surface of the abrasive pad 482. The head 465 is rotated in this state, and cleaning the polished surface 464*a* is continued. Subsequently, by raising and moving the head 465, the wafer 464 is carried to the following stage. Afterward, through ordinary polishing and cleaning steps, the polishing step in the semiconductor manufacturing process is finished.

According to the eighth embodiment, since the polished surface 464*a* is cleaned with a large volume of the cleaning fluid 490*a* held in the water tank 490, the polished surface 464*a* is cleaned very effectively.

It should be noted that, although the water tank 490 is raised and the platen 481 is neither elevated nor lowered in the eighth embodiment, conversely, the platen 481 may be lowered, and the water tank 490 may be brought to a halt.

Ninth Embodiment

A ninth embodiment of the present invention relates to procedures after the occurrence of interlock in case of an emergency.

Figure 33:
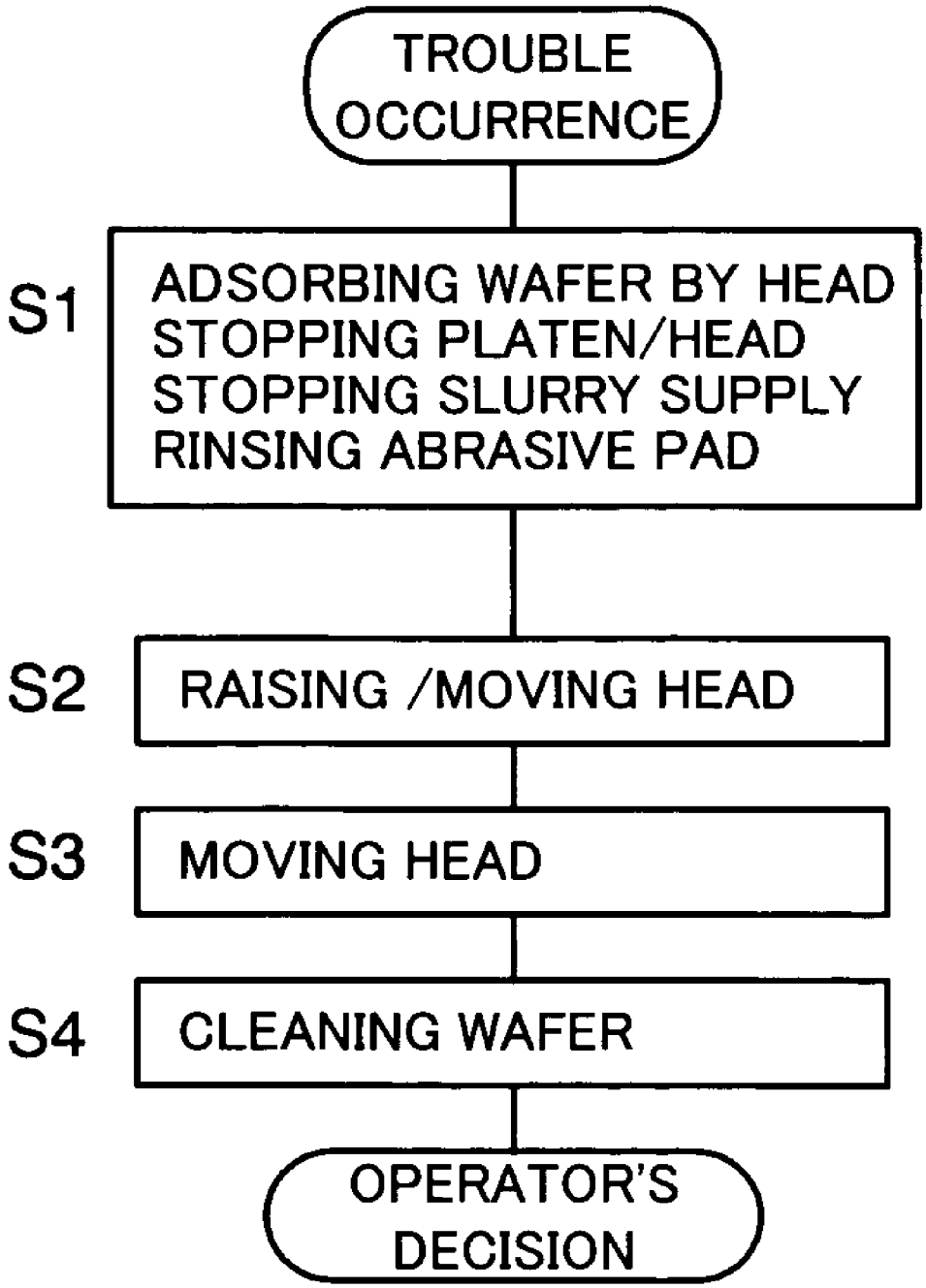
FIG. 33 is a sequence in case of trouble of a polishing machine in a ninth embodiment of the present invention.

FIG. 33 shows a sequence in case of trouble of a polishing machine of the ninth embodiment according to the present invention. The polishing machine according to the fourth embodiment includes an emergency stopping means and an emergency cleaning means. The emergency stopping means and the emergency cleaning means are controlled, for example, by a computer (sequencer included), and execute a sequence in case of trouble. Except for theses means and the sequence in case of trouble, the polishing machine according to the ninth embodiment is the same as the above polishing machine according to the sixth embodiment shown in FIG. 27.

Figure 1:
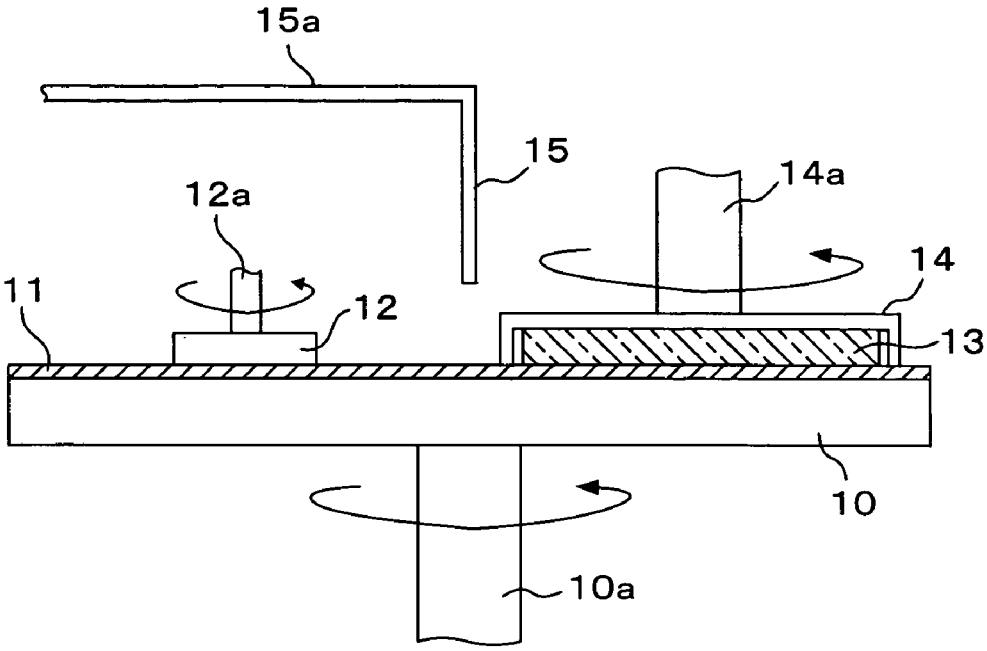
FIG. 1 (Prior Art)
FIG. 1 is a schematic diagram showing an outline of a CMP machine used for manufacturing semiconductor devices.
Figure 2:
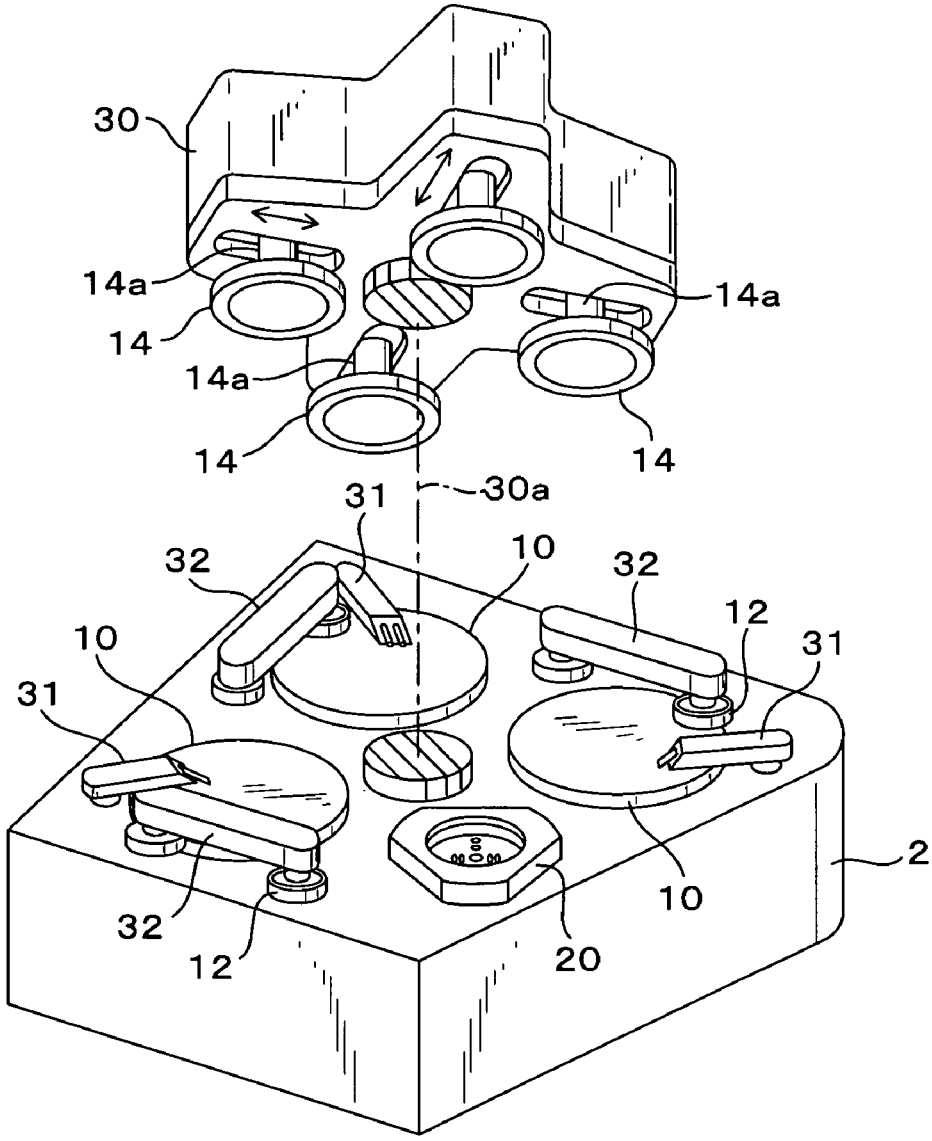
FIG. 2 (Prior Art)
FIG. 2 is a perspective view of a conventional CMP machine.
Figure 3:
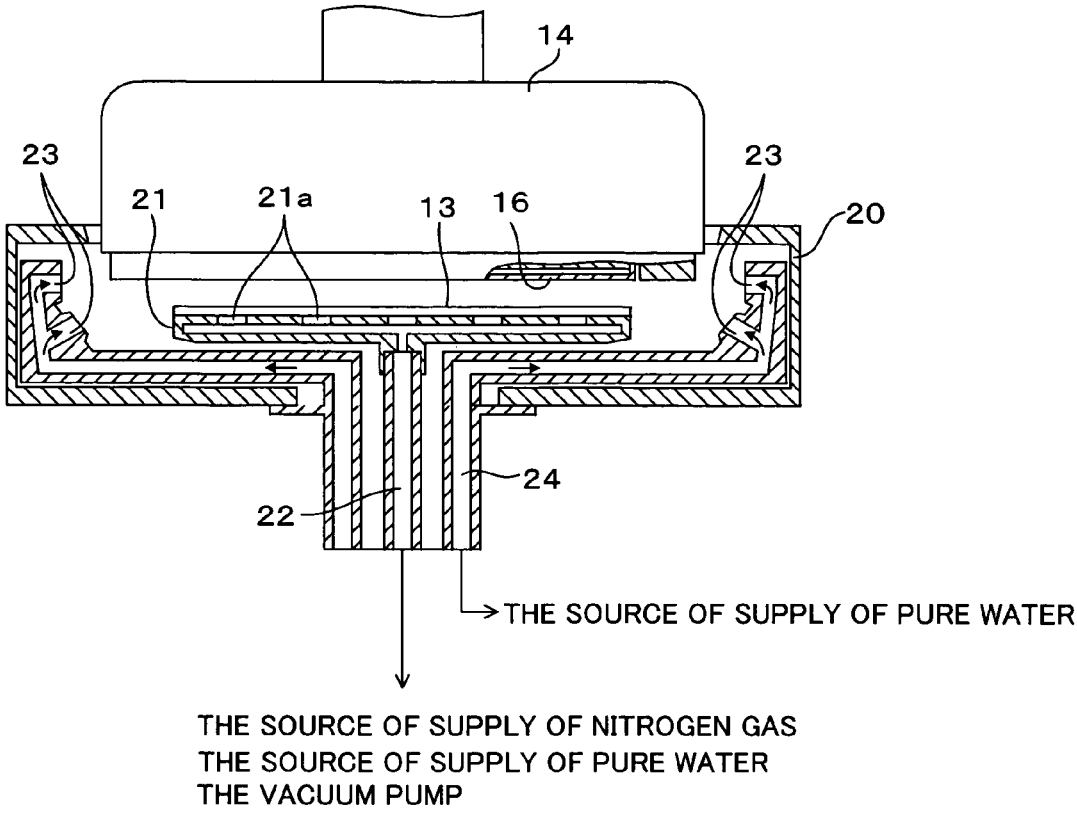
FIG. 3 (Prior Art)
FIG. 3 is a cross-sectional view showing a load cup and a polishing head of the CMP machine.
Figure 4A:
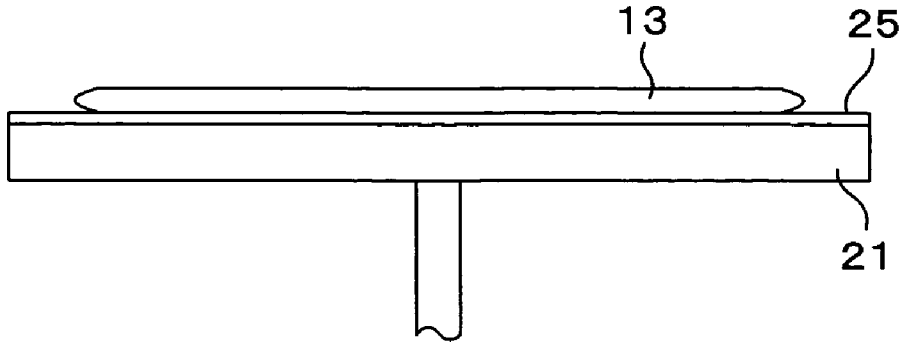
FIG. 4A (Prior Art)
FIG. 4A is a side view showing a condition in which a pedestal pad (a workpiece supporting table pad) is disposed on the top of a pedestal (a workpiece supporting table).
Figure 4B:
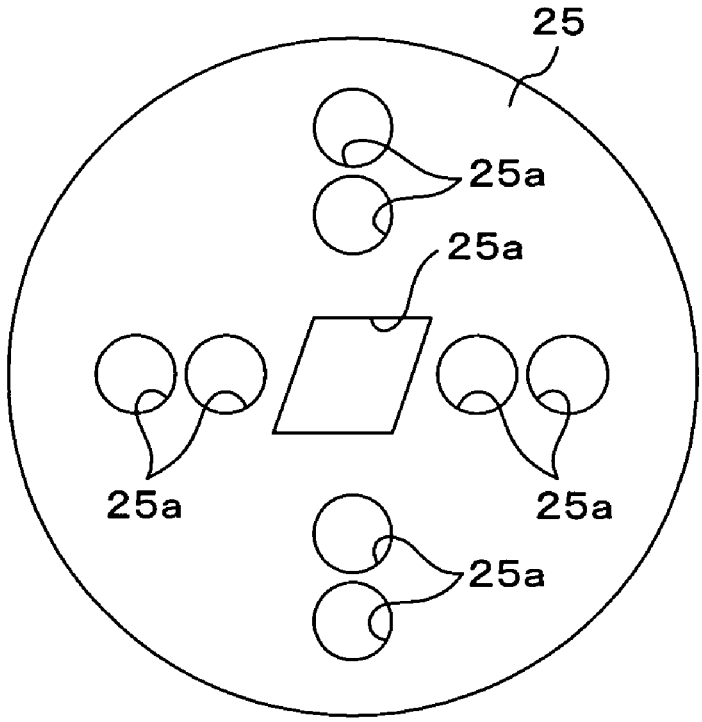
FIG. 4B (Prior Art)
FIG. 4B is a plan view showing a conventional pedestal pad.
Figure 5:
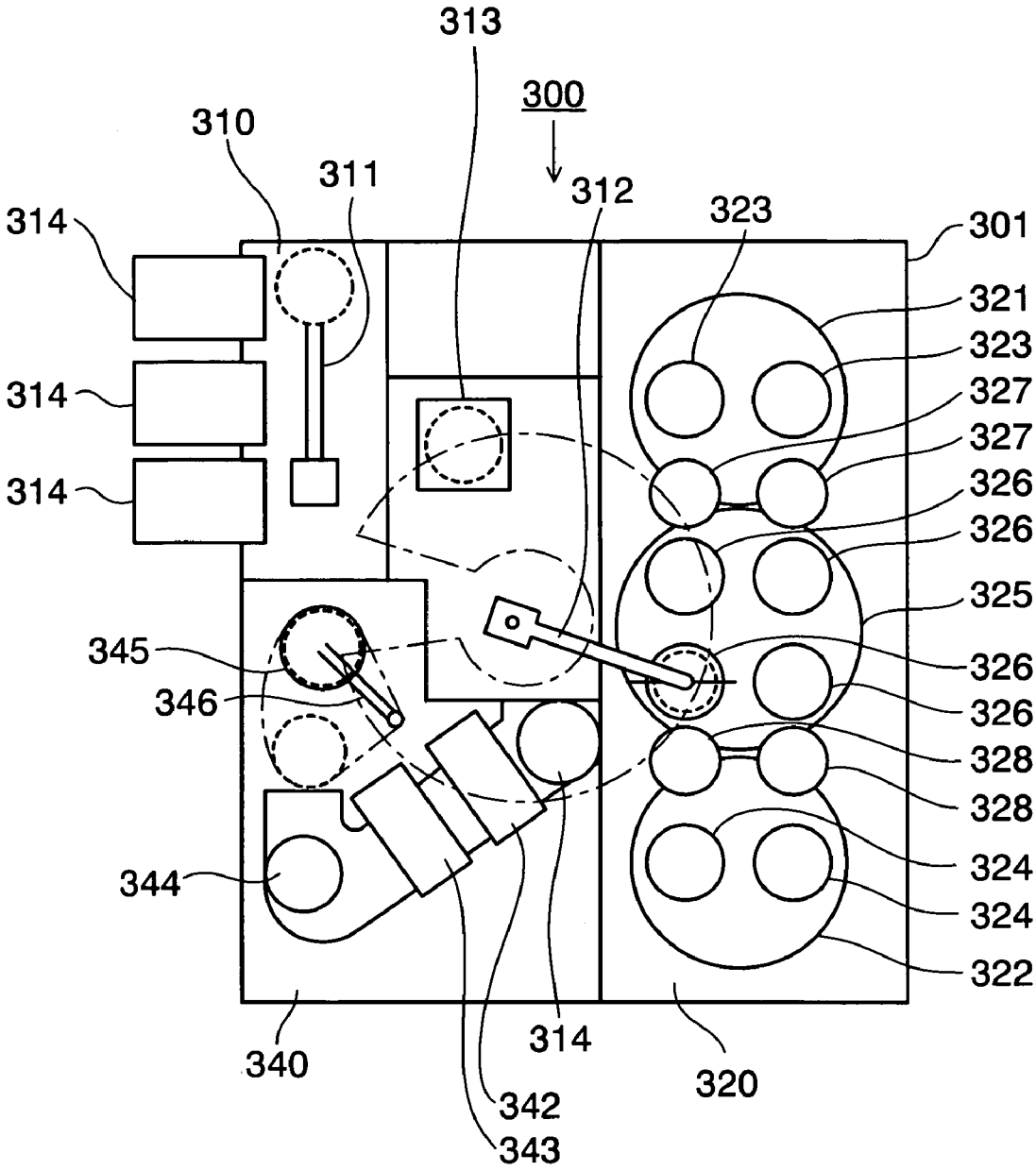
FIG. 5 (Prior Art)
FIG. 5 is a plan view of a conventional polishing machine.
Figure 6A:
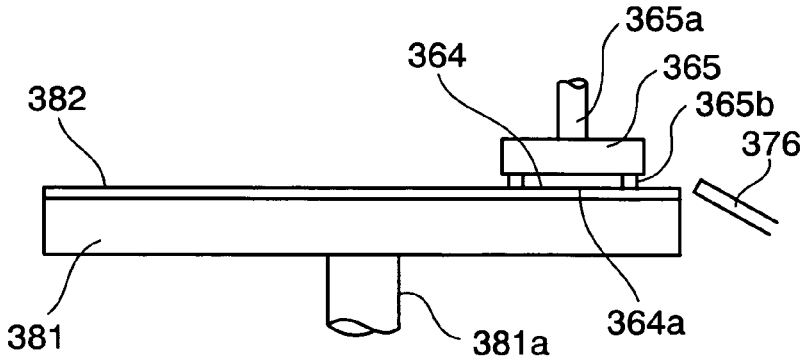
FIG. 6A (Prior Art)
FIGS. 6A and 6B are plan views of the conventional polishing machine.
Figure 6B:
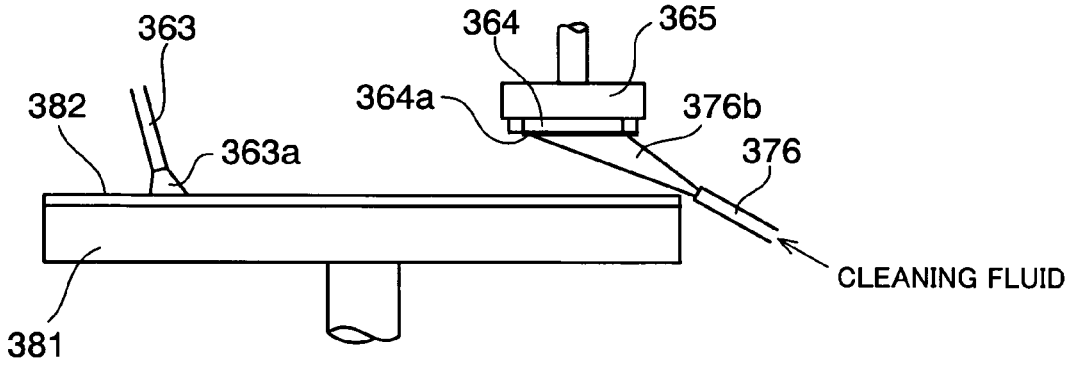
FIG. 6B (Prior Art)
Figure 7:
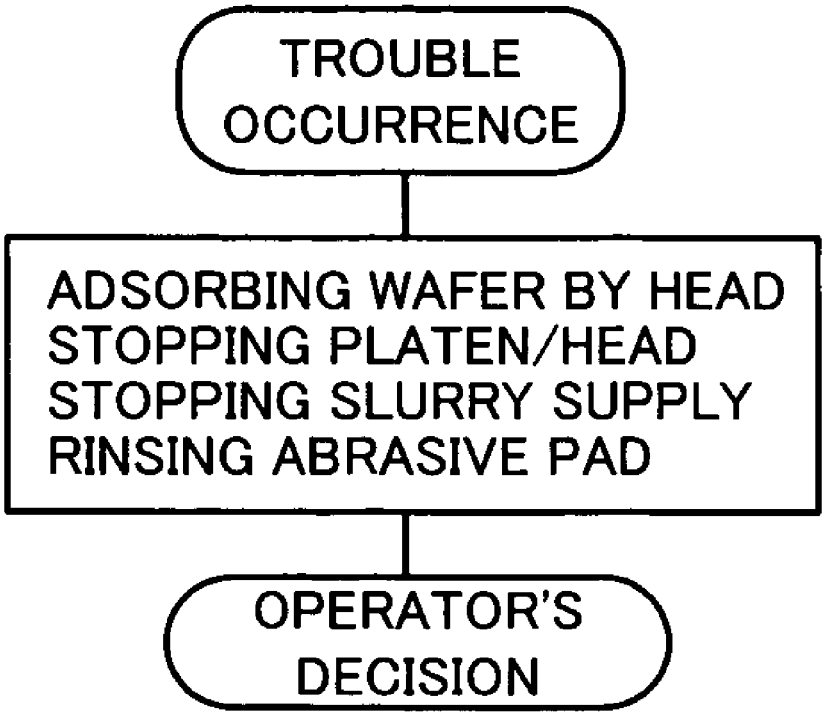
FIG. 7 (Prior Art)
FIG. 7 is a sequence in case of trouble of the conventional polishing machine.

The emergency stopping means, when detecting a machine's abnormality caused by the occurrence of trouble during polishing by CMP, gives an alarm immediately and executes Sequences S1 and S2 (see FIG. 33). Sequence S1 takes the following steps (1)–(3): (1) holding the wafer by being adsorbed to the head; (2) stopping the rotation of the platen and head; and (3) stopping the supply of slurry on the abrasive pad and supplying a cleaning fluid on the abrasive pad so as to rinse the abrasive pad. The steps are the same as in the above described conventional sequence shown in FIG. 7 except that the polishing machine is stopped after raising the head. Next, in Sequence S2, the emergency stopping means raises the head and holds the wafer away from the abrasive pad.

Next, the emergency cleaning means moves the head to a cleaning apparatus, for example, cleaning stages 427 and 428 shown in FIG. 27 (Sequence S3) and carries the wafer to the cleaning stages 427 and 428 so as to take the step of cleaning the wafer (Sequence S4). Instead of the step, the wafer cleaning step according to the sixth or seventh embodiment may be taken.

The polishing machine then stops, waiting for an operator's inspection and operation.

In this embodiment, since the polished surface is cleaned and the polishing machine is then stopped at an emergency stop, the polishing machine waits in a state that the slurry left on the polished surface has been cleaned. Therefore, the period when the polished surface, to which slurry is adhered, is exposed to an atmosphere is equal to that in the normal polishing-cleaning steps. Corrosion deep enough to corrode all the layers of the metal wiring (copper wiring in particular) appearing on the polished surface does not occur. Consequently, even when repolishing is performed by the operator's operation after the inspection, normal polishing can be continued easily only by removing the corrosion of the wiring surface layer shallowly. Therefore, semiconductor devices can be manufactured at higher yield rate.

What is claimed is:

1. A polishing machine comprising:

a polishing stage;

a workpiece supporting table;

a workpiece supporting table pad, which is arranged on the top of the workpiece supporting table, and which is non-absorbable to a fluid at least in a surface thereof to come into contact with a workpiece; and a polishing head, which transfers the workpiece placed and held on the workpiece supporting table pad to the polishing stage, and which returns the workpiece, which has been polished in the polishing stage, to the workpiece supporting table pad.

2. The polishing machine according to claim 1, wherein the surface of the workpiece supporting table pad which comes into contact with the workpiece is smooth, and dose not have any cavity which holds the fluid.

3. The polishing machine according to claim 1, wherein the workpiece supporting table includes nozzles, and wherein the workpiece supporting table pad includes holes respectively at positions corresponding to the nozzles of the workpiece supporting table.

4. The polishing machine according to claim 3, wherein the nozzles of the workpiece supporting table are connected to a source of supply of the fluid and a vacuum device.

5. A workpiece supporting table pad of a polishing machine, formed of resin, which is arranged on the top of a workpiece supporting table, and on which a pre-polished or post-polished workpiece is temporarily placed and held, wherein at least a surface of the workpiece supporting table pad which comes into contact with the workpiece is non-absorbable to a fluid.

6. The workpiece supporting table pad according to claim 5, wherein the surface which comes into contact with the workpiece is smooth, and does not have any cavity which holds the fluid.

7. The workpiece supporting table pad according to claim 5, wherein holes are formed respectively at positions corresponding to nozzles provided to the workpiece supporting table.

8. The workpiece supporting table pad according to claim 5, wherein a plurality of grooves extending to the outer edge are formed in the surface which comes into contact with the workpiece.

9. The workpiece supporting table pad according to claim 5, wherein the workpiece supporting table pad includes a plurality of individual pad-constituting members, and wherein the pad-constituting members are stuck to the top of the workpiece supporting table.

10. The workpiece supporting table pad according to claim 9, wherein at least parts of the plurality of pad-constituting members are formed so as to be shaped like such a ring that the parts surround nozzles provided to the workpiece supporting table.

11. A polishing method comprising the steps of:

placing and holding a workpiece on the top of a workpiece supporting table;

transferring the workpiece from the top of the workpiece supporting table to a polishing stage by use of a polishing head;

polishing the workpiece by use of the polishing stage; and returning the workpice, which has been polished by use of the polishing stage, to the top of the workpiece supporting table, wherein a workpiece supporting table pad is arranged on the top of the workpiece supporting table, at least a surface of the workpiece supporting table pad being non-absorbable to a fluid.

12. The polishing method according to claim 11, wherein a slurry including an abrasive is supplied to the polishing stage.

13. The polishing method according to claim 11, wherein a slurry including an abrasive and a chemical polishing ingredient is supplied to the polishing stage.

14. The polishing method according to claim 11, wherein the workpiece is a semiconductor wafer.

15. The polishing method according to claim 14, wherein a metallic film formed on the top of the semiconductor wafer is polished by use of the polishing method.

16. The polishing method according to claim 15, wherein the slurry includes an ingredient for eluting a metal constituting the metallic film.

17. The polishing method according to claim 15, wherein the slurry includes an ingredient for oxidizing a surface of the metallic film.

18. The polishing method according to claim 15, wherein a slurry for ionizing, and thereby eluting, a metal constituting the metallic film is used.

19. The polishing method according to claim 14, wherein a semiconductor film formed on the top of the semiconductor wafer is polished.

20. The polishing method according to claim 14, wherein an insulating film formed on the top of the semiconductor wafer is polished.

* * * * *